US011003102B2

(12) United States Patent
Ishiduka et al.

(10) Patent No.: US 11,003,102 B2
(45) Date of Patent: May 11, 2021

(54) ELECTROPHOTOGRAPHIC IMAGE FORMING APPARATUS AND PROCESS CARTRIDGE

(71) Applicant: CANON KABUSHIKI KAISHA, Tokyo (JP)

(72) Inventors: Yuka Ishiduka, Suntou-gun (JP); Tsutomu Nishida, Mishima (JP); Hideharu Shimozawa, Numazu (JP); Nobuhiro Nakamura, Numazu (JP); Hiroyuki Watanabe, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/815,485

(22) Filed: Mar. 11, 2020

(65) Prior Publication Data

US 2020/0292949 A1 Sep. 17, 2020

(30) Foreign Application Priority Data

Mar. 15, 2019 (JP) ..... JP2019-049031

(51) Int. Cl.
*G03G 5/05* (2006.01)
*G03G 5/147* (2006.01)
(Continued)

(52) U.S. Cl.
CPC ..... *G03G 5/14734* (2013.01); *G03G 9/0819* (2013.01); *G03G 9/08711* (2013.01);
(Continued)

(58) Field of Classification Search
CPC ..... G03G 5/0571; G03G 5/06142
See application file for complete search history.

(56) References Cited

U.S. PATENT DOCUMENTS 6,991,881 B2 1/2006 Ogaki et al.
6,994,941 B2 2/2006 Tanaka et al.
(Continued)

FOREIGN PATENT DOCUMENTS

JP 2005-338222 12/2005
JP 2008-090118 4/2008
(Continued)

OTHER PUBLICATIONS

U.S. Appl. No. 16/272,268, Hideharu Shimozawa, filed Feb. 11, 2019.
(Continued)

*Primary Examiner* — Peter L Vajda
(74) *Attorney, Agent, or Firm* — Venable LLP

(57) ABSTRACT

Provided are an electrophotographic apparatus and a process cartridge each capable of suppressing the occurrence of a black spot (white background contamination) in an output image under a low-temperature and low-humidity environment. The electrophotographic apparatus includes: an electrophotographic photosensitive member including a support, a photosensitive layer, and a protective layer in the stated order; an exposing device; a developing device; and a cleaning device, wherein the protective layer has a triarylamine structure and a specific structure at a ratio in a specific range, and a toner contains toner particles each containing at least a resin, and an external additive. The toner has a volume-average particle diameter of 7 μm or more. The external additive contains a compound containing a titanium atom. The ratio of the mass of the compound containing a titanium atom to the total mass of the toner is 0.6 mass % or more.

14 Claims, 1 Drawing Sheet

(51) Int. Cl.

| | |
|---|---|
| ***G03G 9/08*** | (2006.01) |
| ***G03G 9/087*** | (2006.01) |
| ***G03G 9/09*** | (2006.01) |
| ***G03G 9/097*** | (2006.01) |
| ***G03G 15/08*** | (2006.01) |
| ***G03G 21/18*** | (2006.01) |

(52) U.S. Cl.
CPC ..... *G03G 9/0904* (2013.01); *G03G 9/09708* (2013.01); *G03G 15/08* (2013.01); *G03G 21/18* (2013.01)

(56) References Cited

U.S. PATENT DOCUMENTS

| | | | |
|---|---|---|---|
| 7,001,699 | B2 | 2/2006 | Tanaka et al. |
| 7,910,274 | B2 | 3/2011 | Tanaka et al. |
| 8,088,541 | B2 | 1/2012 | Tanaka et al. |
| 8,455,170 | B2 | 6/2013 | Nakamura et al. |
| 8,481,236 | B2 | 7/2013 | Tanaka et al. |
| 8,632,935 | B2 | 1/2014 | Sugiyama |
| 8,765,335 | B2 | 7/2014 | Tanaka et al. |
| 8,846,281 | B2 | 9/2014 | Okuda et al. |
| 8,865,381 | B2 | 10/2014 | Tanaka et al. |
| 9,029,054 | B2 | 5/2015 | Okuda et al. |
| 9,040,214 | B2 | 5/2015 | Fujii et al. |
| 9,046,797 | B2 | 6/2015 | Fujii et al. |
| 9,063,505 | B2 | 6/2015 | Sekiya et al. |
| 9,069,267 | B2 | 6/2015 | Kaku et al. |
| 9,114,565 | B2 | 8/2015 | Kawai et al. |
| 9,170,506 | B2 | 10/2015 | Tanaka et al. |
| 9,170,507 | B2 | 10/2015 | Sugiyama et al. |
| 9,256,145 | B2 | 2/2016 | Fujii et al. |
| 9,304,416 | B2 | 4/2016 | Noguchi et al. |
| 9,372,417 | B2 | 6/2016 | Fujii et al. |
| 9,372,418 | B2 | 6/2016 | Shida et al. |
| 9,372,419 | B2 | 6/2016 | Tsuji et al. |
| 9,436,106 | B2 | 9/2016 | Kuno et al. |
| 9,459,545 | B2 | 10/2016 | Tanaka et al. |
| 9,523,929 | B2 | 12/2016 | Nakamura et al. |
| 9,535,346 | B2 | 1/2017 | Sekiya et al. |
| 9,541,850 | B2 | 1/2017 | Nishida et al. |
| 9,563,139 | B2 | 2/2017 | Kawahara et al. |
| 9,599,915 | B2 | 3/2017 | Anezaki et al. |
| 9,599,917 | B2 | 3/2017 | Okuda et al. |
| 9,645,515 | B2 | 5/2017 | Kuno et al. |
| 9,645,516 | B2 | 5/2017 | Kawahara et al. |
| 9,684,277 | B2 | 6/2017 | Yamamoto et al. |
| 9,726,992 | B2 | 8/2017 | Sakuma et al. |
| 9,772,596 | B2 | 9/2017 | Mitsui et al. |
| 9,869,032 | B2 | 1/2018 | Kawahara et al. |
| 10,073,362 | B2 | 9/2018 | Fujii et al. |
| 10,372,050 | B2 | 8/2019 | Nishi et al. |
| 10,416,581 | B2 | 9/2019 | Ito et al. |
| 10,539,892 | B2 | 1/2020 | Nishida et al. |
| 10,558,132 | B2 | 2/2020 | Ishiduka et al. |
| 10,558,133 | B2 | 2/2020 | Nakamura et al. |
| 2005/0208402 | A1 | 9/2005 | Tanaka et al. |
| 2005/0266325 | A1 | 12/2005 | Yanagawa et al. |
| 2012/0196214 | A1* | 8/2012 | Sonobe ..... G03G 5/0596 430/56 |
| 2014/0004450 | A1 | 1/2014 | Tokimitsu et al. |
| 2014/0093281 | A1 | 4/2014 | Takahashi et al. |
| 2015/0185630 | A1 | 7/2015 | Ito et al. |
| 2015/0185631 | A1 | 7/2015 | Black et al. |
| 2015/0185634 | A1 | 7/2015 | Sekiya et al. |
| 2015/0185642 | A1 | 7/2015 | Bellino et al. |
| 2015/0277246 | A1 | 10/2015 | Kaku et al. |
| 2015/0277247 | A1 | 10/2015 | Sekiya et al. |
| 2015/0316863 | A1 | 11/2015 | Tanaka et al. |
| 2015/0346616 | A1 | 12/2015 | Kawahara et al. |
| 2015/0346617 | A1 | 12/2015 | Kawahara et al. |
| 2015/0362847 | A1 | 12/2015 | Tanaka et al. |
| 2016/0091807 | A1 | 3/2016 | Tanaka et al. |
| 2016/0131985 | A1 | 5/2016 | Tanaka et al. |
| 2017/0060008 | A1 | 3/2017 | Okuda et al. |
| 2017/0184986 | A1 | 6/2017 | Black et al. |
| 2017/0307990 | A1* | 10/2017 | Sakimura ..... G03G 5/14726 |
| 2018/0004107 | A1 | 1/2018 | Black et al. |
| 2019/0033737 | A1 | 1/2019 | Iguchi et al. |
| 2019/0265601 | A1 | 8/2019 | Nishida et al. |
| 2019/0369512 | A1 | 12/2019 | Okuda et al. |
| 2019/0369514 | A1 | 12/2019 | Watanabe et al. |
| 2019/0369517 | A1 | 12/2019 | Watanabe et al. |
| 2019/0369529 | A1 | 12/2019 | Yagi et al. |

FOREIGN PATENT DOCUMENTS

| | | |
|---|---|---|
| JP | 2009-193016 | 8/2009 |
| JP | 2010-026378 | 2/2010 |
| JP | 2019-028428 | 2/2019 |

OTHER PUBLICATIONS

U.S. Appl. No. 16/785,721, Hideharu Shimozawa, filed Feb. 10, 2020.

* cited by examiner

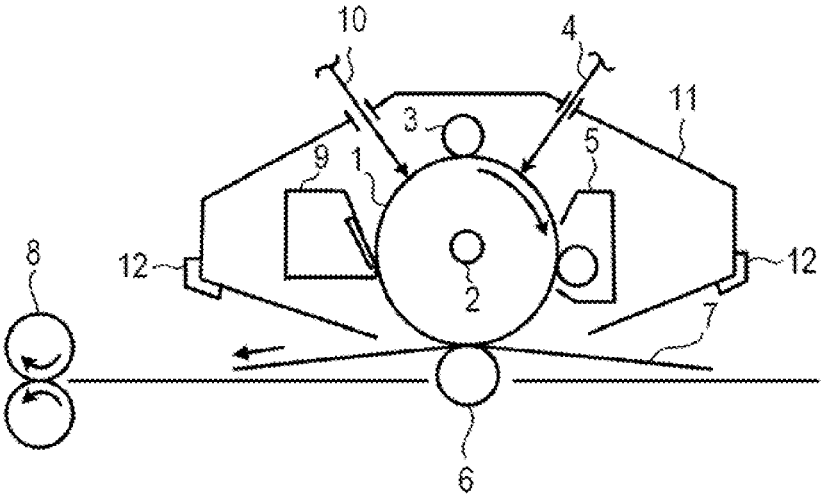
10
4
11
3
5
9
1
8
12
12
2
7
6

ELECTROPHOTOGRAPHIC IMAGE FORMING APPARATUS AND PROCESS CARTRIDGE

BACKGROUND OF THE INVENTION

Field of the Invention

The present disclosure is directed to an electrophotographic image forming apparatus (hereinafter, referred as "electrophotographic apparatus") and a process cartridge.

Description of the Related Art

A wide variety of investigations have heretofore been made on an electrophotographic photosensitive member to be mounted on an electrophotographic apparatus or a process cartridge in order to improve its image quality and durability. An example thereof is an investigation in which a polyfunctional radically polymerizable monomer is used in a surface of the electrophotographic photosensitive member (hereinafter sometimes referred to as "photosensitive member") to improve its wear resistance (mechanical durability).

However, when the polyfunctional radically polymerizable monomer is used, although the wear resistance is enhanced, surface resistance of the resultant film is liable to be uneven, resulting in a problem in that a black spot (white background contamination) is liable to occur. More specifically, in a portion where the surface resistance of the film is low, despite the portion being a non-image portion, the black spot occurs through adhesion of toner.

U.S. Patent Application Publication No. 2015/185642 discloses a technology for improving the wear resistance of the photosensitive member through use of a protective layer obtained by polymerizing a monomer having a triarylamine structure and a monomer having a urethane group and an acryl group.

In addition, Japanese Patent Application Laid-Open No. 2010-26378 discloses a technology for providing a photosensitive member capable of providing an image free of any black spot by regulating a hardness of the protective layer through use of a monomer having a triarylamine structure.

SUMMARY OF THE INVENTION

According to an investigation made by the inventors, it has been found that even the configurations described in U.S. Patent Application Publication No. 2015/185642 and Japanese Patent Application Laid-Open No. 2010-26378 each have room for amelioration with regard to the occurrence of a black spot under a low-temperature and low-humidity environment.

One aspect of the present disclosure is directed to providing an electrophotographic apparatus capable of suppressing the occurrence of a black spot under a low-temperature and low-humidity environment.

Another aspect of the present disclosure is directed to providing a process cartridge conducive to the suppression of the occurrence of a black spot under a low-temperature and low-humidity environment.

According to one aspect of the present disclosure, there is provided an electrophotographic image forming apparatus including: an electrophotographic photosensitive member; a charging device configured to charge the electrophotographic photosensitive member; an exposing device configured to expose the electrophotographic photosensitive member to form an electrostatic latent image; a developing device configured to develop the electrostatic latent image with a toner to form a toner image; a transfer device configured to transfer the toner image from the electrophotographic photosensitive member onto a transfer material; and a cleaning device configured to remove the toner remaining on the electrophotographic photosensitive member with a cleaning blade after the toner image is transferred from the electrophotographic photosensitive member by the transfer device, wherein the developing device contains the toner, the toner contains toner particles each containing at least a resin, and an external additive, the toner has a volume-average particle diameter of 7 μm or more, the external additive contains a compound containing a titanium atom, a ratio B of a mass of the compound containing a titanium atom to a total mass of the toner is 0.6 mass % or more, the electrophotographic photosensitive member includes a support, a photosensitive layer, and a protective layer in the stated order, the protective layer contains a resin having a triarylamine structure and at least one structure selected from the group consisting of a structure represented by the general formula (1) and a structure represented by the general formula (2):

(1)

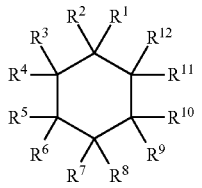

in the general formula (1), among $R^1$ to $R^{12}$, at least two of $R^1$, $R^5$, and $R^9$ each represent a structure represented by the general formula (3), and the others each represent a hydrogen atom or a methyl group;

(2)

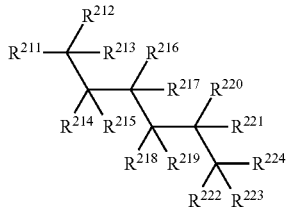

in the general formula (2), among $R^{211}$ to $R^{224}$, $R^{211}$ and $R^{224}$ each represent the structure represented by the general formula (3), and the others each represent a hydrogen atom or a methyl group:

(3)

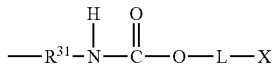

in the general formula (3), $R^{31}$ represents a single bond or a methylene group that may have a substituent, X represents a group having a structure represented by the general formula (4), and L represents a group that links a non-carbonyl oxygen atom in the general formula (3) and a non-carbonyl oxygen atom in the general formula (4):

(4)

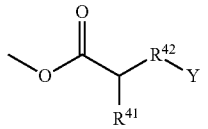

in the general formula (4), $R^{41}$ represents a hydrogen atom or a methyl group, $R^{42}$ represents a methylene group, and Y represents a bonding site with a polymer chain of the resin contained in the protective layer, and wherein a ratio A (mass %) of a total content of a structure represented by the general formula (1') and a structure represented by the general formula (2') in the protective layer to a total mass of the protective layer, which is determined by a pyrolysis-gas chromatography-mass spectrometric analysis of the protective layer, is 10 mass % or more and 20 mass % or less:

(1')

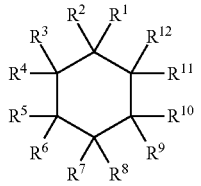

in the general formula (1'), among $R^1$ to $R^{12}$, at least two of $R^1$, $R^5$, and $R^9$ each represent a structure represented by the general formula (3'), and the others each represent a hydrogen atom or a methyl group;

(2')

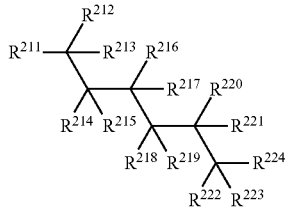

in the general formula (2'), among $R^{211}$ to $R^{224}$, $R^{211}$ and $R^{224}$ each represent the structure represented by the general formula (3'), and the others each represent a hydrogen atom or a methyl group:

$$—R^{31}—N=C=O \quad (3')$$

in the general formula (3'), $R^{31}$ represents a single bond or a methylene group that may have a substituent.

According to another aspect of the present disclosure, there is provided a process cartridge, which is removably mounted onto a main body of an electrophotographic apparatus, the process cartridge including: an electrophotographic photosensitive member; a charging device configured to charge the electrophotographic photosensitive member; and a developing device configured to supply a toner to the electrophotographic photosensitive member having an electrostatic latent image formed thereon to form a toner image on a surface of the electrophotographic photosensitive member, wherein the developing device contains the toner, the toner contains toner particles each containing at least a resin, and an external additive, the toner has a volume-average particle diameter of 7 μm or more, the external additive contains a compound containing a titanium atom, a ratio B of a mass of the compound containing a titanium atom to a total mass of the toner is 0.6 mass % or more, the electrophotographic photosensitive member includes a support, a photosensitive layer, and a protective layer in the stated order, the protective layer contains a resin having a triarylamine structure and at least one structure selected from the group consisting of a structure represented by the general formula (1) and a structure represented by the general formula (2):

(1)

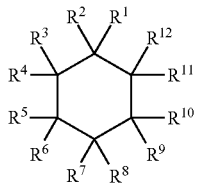

in the general formula (1), among $R^1$ to $R^{12}$, at least two of $R^1$, $R^5$, and $R^9$ each represent a structure represented by the general formula (3), and the others each represent a hydrogen atom or a methyl group;

(2)

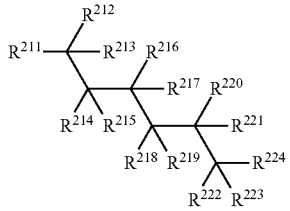

in the general formula (2), among $R^{211}$ to $R^{224}$, $R^{211}$ and $R^{224}$ each represent the structure represented by the general formula (3), and the others each represent a hydrogen atom or a methyl group:

(3)

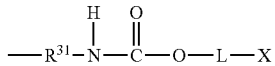

in the general formula (3), $R^{31}$ represents a single bond or a methylene group that may have a substituent, X represents a structure represented by the general formula (4), and L represents a group that links a non-carbonyl oxygen atom in the general formula (3) and a non-carbonyl oxygen atom in the general formula (4):

(4)

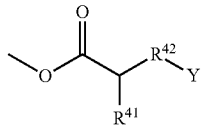

in the general formula (4), $R^{41}$ represents a hydrogen atom or a methyl group, $R^{42}$ represents a methylene group, and Y represents a bonding site with a polymer chain of the resin contained in the protective layer, and wherein a ratio A (mass %) of a total content of a structure represented by the general formula (1') and a structure represented by the general formula (2') in the protective layer to a total mass of the protective layer, which is determined by a pyrolysis-gas chromatography-mass spectrometric analysis of the protective layer, is 10 mass % or more and 20 mass % or less:

(1')

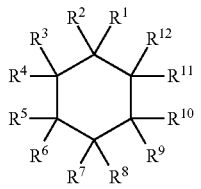

in the general formula (1'), among $R^1$ to $R^{12}$, at least two of $R^1$, $R^5$, and $R^9$ each represent a structure represented by the general formula (3'), and the others each represent a hydrogen atom or a methyl group;

(2')

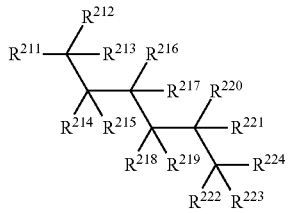

in the general formula (2'), among $R^{211}$ to $R^{224}$, $R^{211}$ and $R^{224}$ each represent the structure represented by the general formula (3'), and the others each represent a hydrogen atom or a methyl group:

$$—R^{31}—N=C=O \quad (3)$$

in the general formula (3'), $R^{31}$ represents a single bond or a methylene group that may have a substituent.

Further features of the present invention will become apparent from the following description of exemplary embodiments with reference to the attached drawing.

BRIEF DESCRIPTION OF THE DRAWINGS

FIG. 1 is an illustration of an example of a schematic configuration of an electrophotographic apparatus according to one aspect of the present disclosure.

DESCRIPTION OF THE EMBODIMENTS

The present disclosure is described in detail below by way of preferred embodiments.

An electrophotographic apparatus according to one aspect of the present disclosure includes: an electrophotographic photosensitive member including a support, a photosensitive layer, and a protective layer in the stated order; a charging device configured to charge the electrophotographic photosensitive member; an exposing device configured to expose the electrophotographic photosensitive member to form an electrostatic latent image; a developing device configured to develop the electrostatic latent image with a toner to form a toner image; a transfer device configured to transfer the toner image from the electrophotographic photosensitive member onto a transfer material; and a cleaning device configured to remove the toner remaining on the electrophotographic photosensitive member with a cleaning blade after the toner image is transferred from the electrophotographic photosensitive member by the transfer device.

The developing device contains the toner. In addition, the toner contains toner particles each containing at least a resin, and an external additive. The toner has a volume-average particle diameter of 7 μm or more. The external additive contains a compound containing a titanium atom, and a ratio B of a mass of the compound containing a titanium atom to a total mass of the toner is 0.6 mass % or more.

The electrophotographic photosensitive member includes a support, a photosensitive layer, and a protective layer in the stated order. In addition, the protective layer contains a resin, and the resin contained in the protective layer has a triarylamine structure and at least one selected from the group consisting of a structure represented by the general formula (1) and a structure represented by the general formula (2).

(1)

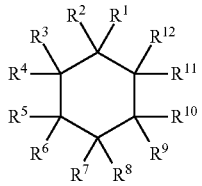

In the general formula (1), among $R^1$ to $R^{12}$, at least two of $R^1$, $R^5$, and $R^9$ each represent a structure represented by the general formula (3), and the others each represent a hydrogen atom or a methyl group.

(2)

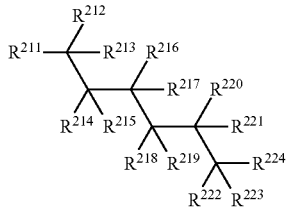

In the general formula (2), among $R^{211}$ to $R^{224}$, $R^{211}$ and $R^{224}$ each represent the structure represented by the general formula (3), and the others each represent a hydrogen atom or a methyl group.

(3)

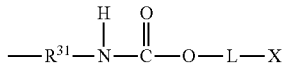

In the general formula (3), $R^{31}$ is a linking group which links the urethane bond in the general formula (3) to a carbon atom constituting a cyclic structure in the general formulae (1) or a carbon atom in the general formulae (2), and $R^{31}$ represents a single bond or a methylene group that may have a substituent, and the substituent is a hydrogen atom or a methyl group, X represents a structure represented by the general formula (4), and L represents a group that links a non-carbonyl oxygen atom in the general formula (3) and a non-carbonyl oxygen atom in the general formula (4). Specific examples of L include a methylene group (—$CH_2$—), a group represented by the general formula (L1), and a group represented by the general formula (L2). That is, L represents at least one selected from the group consisting of a methylene group (—$CH_2$—), a group represented by the general formula (L1), and a group represented by the general formula (L2).

(L1)

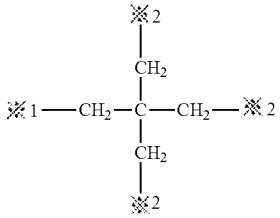

(L2)

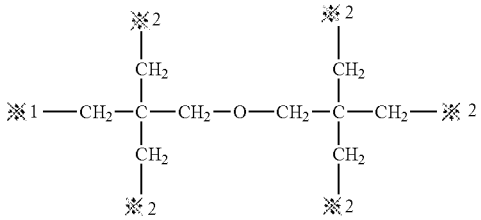

In the general formulae (L1) and (L2), *1 represents a bonding site with the non-carbonyl oxygen atom in the general formula (3), and *2 represents a bonding site with the non-carbonyl oxygen atom in the general formula (4).

(4)

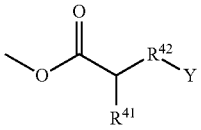

In the general formula (4), $R^{41}$ represents a hydrogen atom or a methyl group, $R^{42}$ represents a methylene group, and Y represents a bonding site with a polymer chain of the resin contained in the protective layer.

Further, a ratio A (mass %) of a total content of a structure represented by the general formula (1') and a structure represented by the general formula (2') in the protective layer to a total mass of the protective layer is 10 mass % or more and 20 mass % or less. The ratio A is determined by a pyrolysis-gas chromatography-mass spectrometric analysis of the protective layer.

(1')

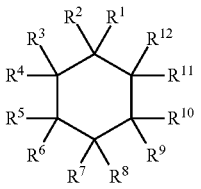

In the general formula (1'), among $R^1$ to $R^{12}$, at least two of $R^1$, $R^5$, and $R^9$ each represent a structure represented by the general formula (3'), and the others each represent a hydrogen atom or a methyl group.

(2')

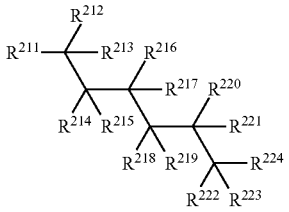

In the general formula (2'), among $R^{211}$ to $R^{224}$, $R^{211}$ and $R^{224}$ each represent the structure represented by the general formula (3'), and the others each represent a hydrogen atom or a methyl group.

$$—R^{31}—N=C=O \quad (3')$$

In the general formula (3'), $R^{31}$ represents a single bond or a methylene group that may have a substituent, and the substituent is a hydrogen atom or a methyl group.

According to an investigation made by the inventors, when the electrophotographic photosensitive member disclosed in U.S. Patent Application Publication No. 2015/185642 was subjected to the formation of an electrophotographic image, a black spot occurred in some cases.

The inventors presume the reason for this to be as described below.

First, a mechanism by which the black spot occurs is described. The protective layer in the electrophotographic photosensitive member disclosed in U.S. Patent Application Publication No. 2015/185642 contains a resin having urethane bonds (hereinafter sometimes referred to as "urethane resin") as a binder resin. Consequently, the toner carrier surface (hereinafter sometimes referred to as "outer surface") of the protective layer is excellent in wear resistance.

However, the urethane resin contains a hard segment in which urethane bonds are aggregated with each other. In addition, the hard segment has high polarity as compared to a soft segment. Accordingly, a region having high polarity is liable to exist in part of the outer surface of the electrophotographic photosensitive member including the protective layer containing the urethane resin. Consequently, when the outer surface of such electrophotographic photosensitive member is charged, charging unevenness is liable to occur. When the outer surface of the electrophotographic photosensitive member includes a portion having a relatively low charging amount, despite the portion being a non-image portion, the black spot sometimes occurs through the adhesion of toner to the low-charging portion.

Meanwhile, in the electrophotographic photosensitive member according to one aspect of the present disclosure, aggregation between urethane bonds is considered to be suppressed by virtue of the protective layer containing the resin having a specific structure. That is, the resin has at least one of the structure represented by the general formula (1) or the structure represented by the general formula (2) in the vicinity of urethane bonds. Those structures are bulky, and hence inhibit aggregation between hard segments in the urethane resin. As a result, in the outer surface of the protective layer, the region having high polarity is prevented from having an excessively large size.

In addition, in pyrolysis-gas chromatography-mass spectrometry of the protective layer, the ratio A (mass %) of the total content of the structure represented by the general formula (1') derived from the structure of the general formula (1) and the structure represented by the general formula (2') derived from the structure of the general formula (2) to the total mass of the protective layer is from 10 mass % to 20 mass %. With this, the aggregation state of the hard segments of the urethane resin is optimized, with the result that the maintenance of the wear resistance of the protective layer and the suppression of the aggregation of the hard segments can both be achieved at high levels.

However, according to an investigation made by the inventors, such electrophotographic photosensitive member has yet to be sufficient for further amelioration of the black spot.

In view of the foregoing, the inventors have made further investigations, and as a result, have found that it is effective for further amelioration of the black spot to combine a specific toner with the above-mentioned electrophotographic photosensitive member.

The toner contains toner particles each containing at least a resin, and an external additive. The toner has a volume-average particle diameter of 7 μm or more. The external additive contains a compound containing a titanium atom. The ratio B of the mass of the compound containing a titanium atom to the total mass of the toner is 0.6 mass % or more.

First, such toner is relatively large as compared to the aggregation size of the hard segments in the outer surface of the above-mentioned electrophotographic photosensitive member. Accordingly, it is considered that electrostatic adhesion of the toner to the outer surface of the electrophotographic photosensitive member can be effectively suppressed.

In addition, by virtue of its large volume-average particle diameter of 7 μm or more, the toner is considered to be weakened in electrostatic interaction with the aggregated portion of the hard segments in the outer surface of the electrophotographic photosensitive member.

Further, by virtue of the fact that the ratio B of the mass of the external additive containing a titanium atom to the total mass of the toner is 0.6 mass % or more, nearly the entire outer surfaces of the toner particles are considered to be uniformly coated with the external additive. Such configuration of the toner is also considered to be effective in weakening the electrostatic interaction between the toner and the aggregated portion of the hard segments.

As described above, it is considered that a further suppressive effect on the black spot is achieved by virtue of the combination of the respective configurations of the electrophotographic photosensitive member and the toner.

The structures in the protective layer of the photosensitive member according to one aspect of the present disclosure may be analyzed by a general analysis technique. For example, the structures may be identified by a measurement method such as solid-state $^{13}$C-NMR measurement, mass spectrometry measurement, pyrolysis-GCMS, or characteristic absorption measurement based on infrared spectroscopic analysis.

When the ratio A of the content of the structures represented by the general formulae (1') and (2') to the total mass of the protective layer, and the ratio B of the mass of the compound containing a titanium atom to the total mass of the toner have a relationship (B/A) of 0.06 or more and 0.12 or less, the action achieved by the mechanism of one aspect of the present disclosure on the interaction between the photosensitive member and the toner is further enhanced to further increase the suppressive effect on the occurrence of the black spot.

When the ratio A is 10 mass % or more and 16 mass % or less, the electrostatic interaction of the photosensitive member with the toner is further reduced. Further, when the ratio B is 0.6 mass % or more and 1.0 mass % or less, the electrostatic interaction of the toner with the photosensitive member is further reduced.

The structures represented by the general formula (1) and the general formula (2) are described. Specific examples of the general formula (1) are shown in the structural formulae (1-1) to (1-3). Of those, the structural formula (1-1) is more preferred from the viewpoint of suppressing the occurrence of the black spot.

(1-1)

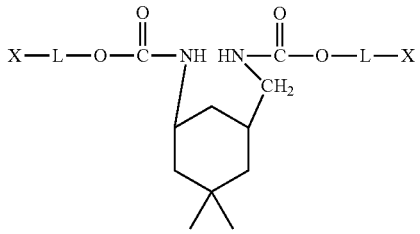

(1-2)

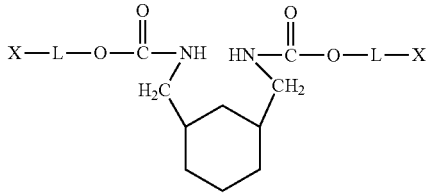

(1-3)

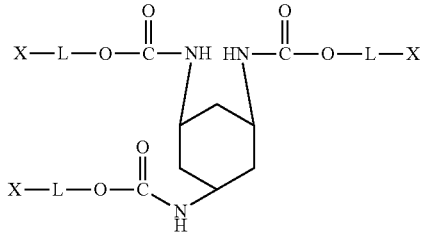

Specific examples of the general formula (2) are shown in the structural formulae (2-1) to (2-3). Of those, the structural formula (2-1) is more preferred from the viewpoint of suppressing the occurrence of the black spot.

(2-1)

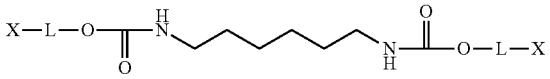

(2-2)

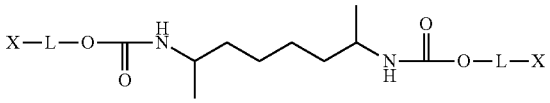

(2-3)

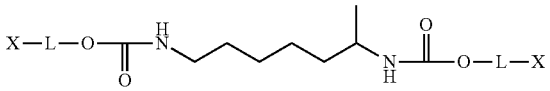

The resin preferably contains, in a molecule thereof, a structure represented by the general formula (5), which is preferably in a state of being bonded to the vicinity of the structure represented by the general formula (1) or (2) in the same molecule. The reason for this is as described below.

Material components having the same structure are liable to aggregate with each other in some cases, and in the protective layer, highly polar urethane bonds or other non-polar portions are liable to aggregate with each other in some cases. Accordingly, when the protective layer contains the structure of the general formula (5), it is considered that its bulkiness can suppress localization due to aggregation of identical components to reduce the electrostatic interaction with the toner.

(5)

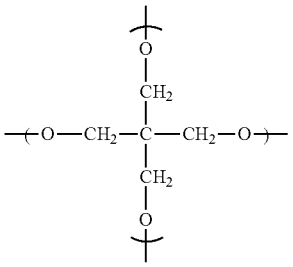

The structure represented by the general formula (5) may be incorporated into the resin by, for example, adopting, as "L" in the general formula (1) or the general formula (2), the linking group having the structure represented by the general formula (L1) or the general formula (L2) described above.

The triphenylamine structure in the resin is a structure needed to allow the protective layer to have a charge-transporting ability. It is preferred in terms of charge-transporting ability that the content of the triphenylamine structure be 20 mass % or more with respect to the total weight of the protective layer.

The resin in the protective layer described above may be, for example, a polymerized product of a composition containing the following first monomer and the following second monomer.

First monomer: A monomer having, in a molecule thereof, at least one of the structure represented by the general formula (1) or the structure represented by the general formula (2), and two or more polymerizable functional groups.

Second monomer: A monomer having, in a molecule thereof, the triarylamine structure and two or more polymerizable functional groups.

Herein, it is preferred that the polymerizable functional groups of the first monomer and the polymerizable functional groups of the second monomer be each independently at least one of an acryloyloxy group or a methacryloyloxy group.

First Monomer

As the first monomer, for example, urethane (meth) acrylate having at least one of the structure represented by the general formula (1) or the structure represented by the general formula (2) may be used. As such urethane (meth) acrylate, a commercially available product may be used, or a synthesized product may be used.

For example, there is given a method involving allowing a compound having an isocyanate group to react with a compound having an acryloyloxy group or a methacryloyloxy group and a hydroxyl group. With regard to reaction conditions, there is given a method involving using, as a catalyst, an existing organotin catalyst (e.g., dibutyltin dilaurate) and using, as a solvent, methyl ethyl ketone or ethyl acetate under the condition of from 50° C. to 80° C.

Also for each of the compound having an isocyanate group and the compound having an acryloyloxy group or a methacryloyloxy group and a hydroxyl group, a commercially available material may be used, or a compound synthesized by a known method may be used. Specific examples of the first monomer are shown in the structural formulae (L-1) to (L-7). That is, the first monomer may preferably be at least one selected from the group consisting of compounds having structural formulae (L-1) to (L-7).

(L-1)

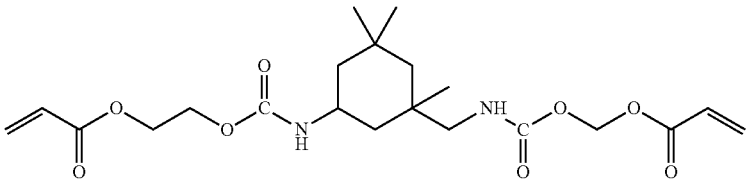

(L-2)

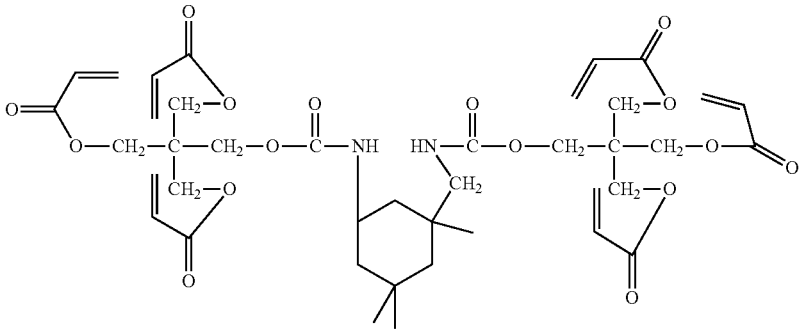

-continued
(L-3)
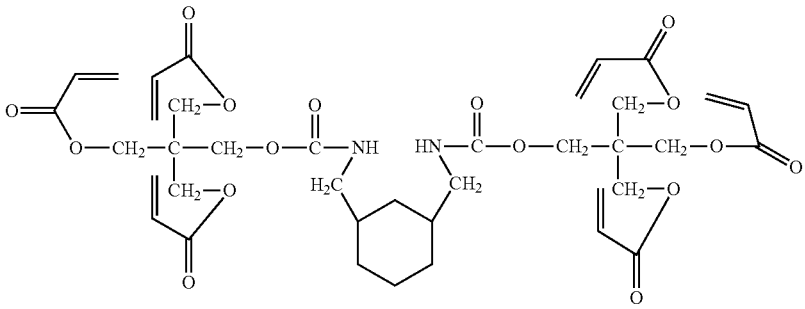
(L-4)
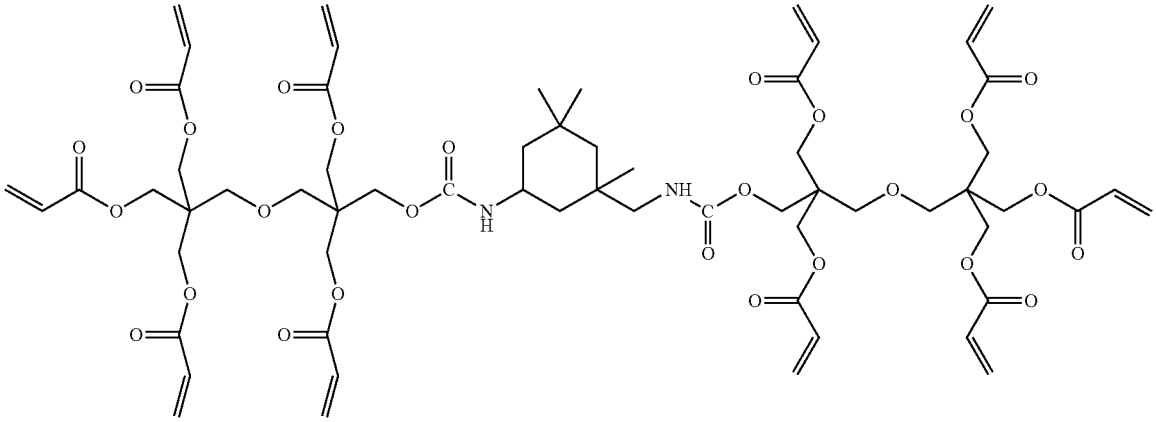
(L-5)
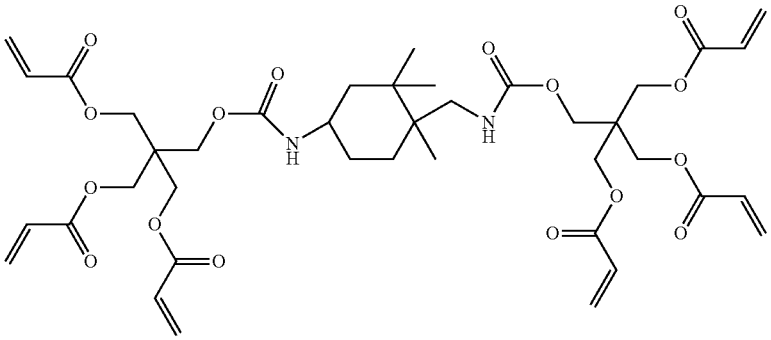
(L-6)
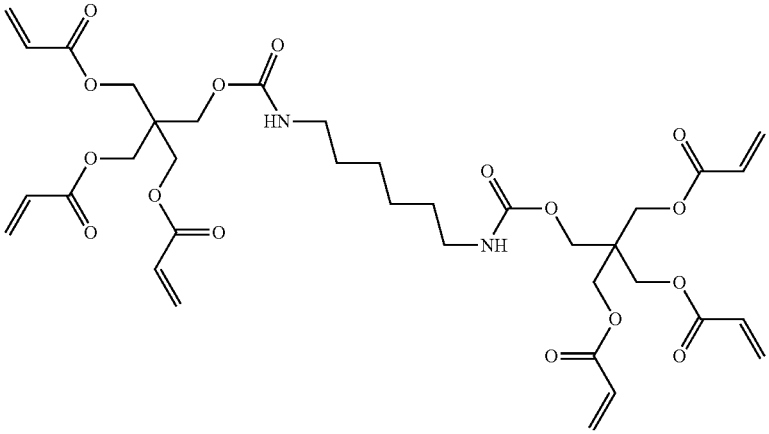

-continued (L-7)

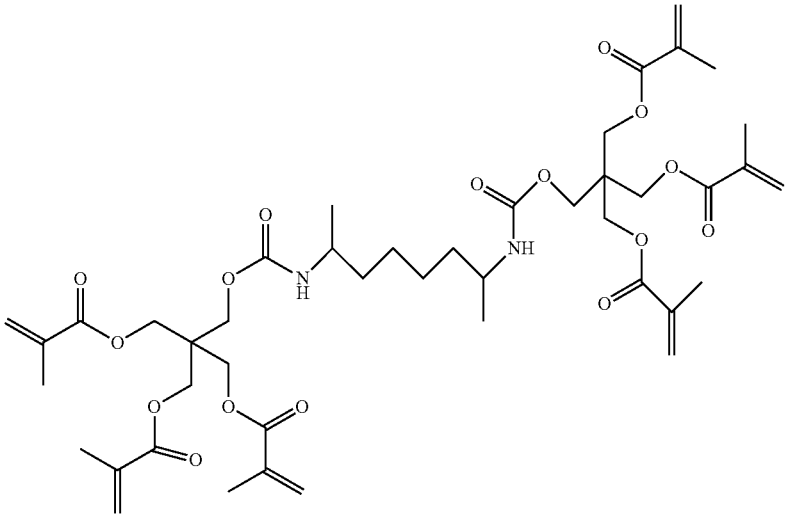

A synthesis example of the urethane acrylate represented by the structural formula (L-1) is described.

The urethane acrylate may be obtained by adding 1 mol of isophorone diisocyanate represented by the structural formula (A-1) (manufactured by Tokyo Chemical Industry Co., Ltd.) and 2 mol of 2-hydroxyethyl acrylate represented by the structural formula (A-2) (product name: LIGHT ESTER HOA, manufactured by Kyoeisha Chemical Co., Ltd.) under the conditions of 80° C. and RH30%. Dibutyltin dilaurate may be used as a catalyst, and methyl ethyl ketone may be used as a solvent.

(A-1)

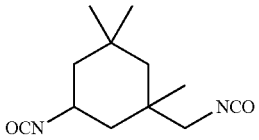

(A-2)

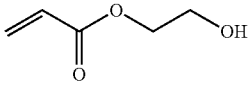

Second Monomer

Specific examples of the second monomer having, in a molecule thereof, the triarylamine structure and two or more acryloyloxy groups or methacryloyloxy groups as polymerizable functional groups are shown in the structural formulae (OCL-1) to (OCL-4). That is, the second monomer may preferably be at least one selected from the group consisting of compounds having structural formulae (OCL-1) to (OCL-4).

(OCL-1)

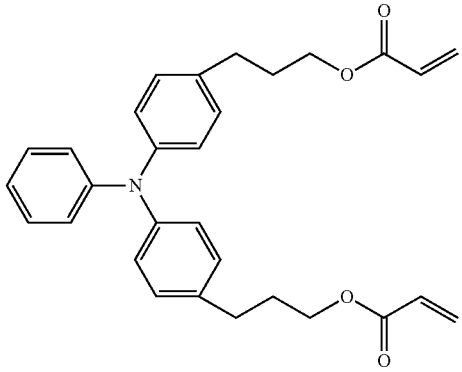

(OCL-2)

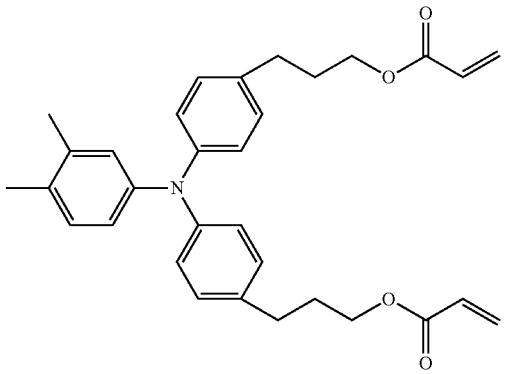

-continued (OCL-3)

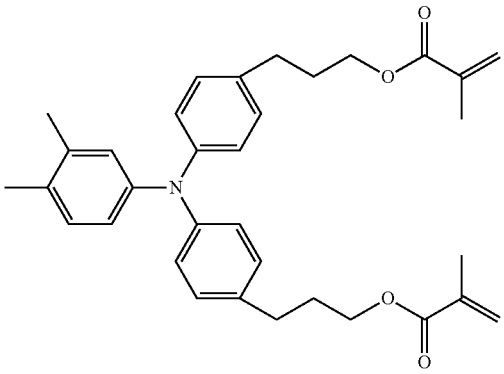

(OCL-4)

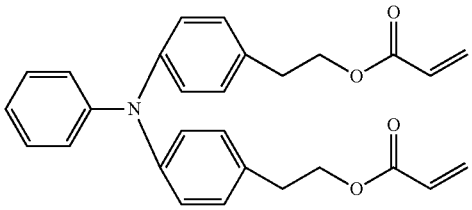

[Electrophotographic Photosensitive Member]

The electrophotographic photosensitive member according to one aspect of the present disclosure includes a support, a photosensitive layer, and a protective layer.

A method of producing the electrophotographic photosensitive member according to one aspect of the present disclosure is, for example, a method involving: preparing coating liquids for the respective layers to be described later; applying the liquids in a desired order of the layers; and drying the liquids. In this case, examples of the method of applying the coating liquid include dip coating, spray coating, inkjet coating, roll coating, die coating, blade coating, curtain coating, wire bar coating, and ring coating. Of those, dip coating is preferred from the viewpoints of efficiency and productivity.

Now, the respective layers are described.

<Support>

The support is preferably a conductive support having conductivity. In addition, examples of the shape of the support include a cylindrical shape, a belt shape, and a sheet shape. Of those, a cylindrical support is preferred. In addition, the outer surface of the support may be subjected to, for example, electrochemical treatment, such as anodization, to form an oxide film, blast treatment, or cutting treatment. A metal, a resin, glass, or the like is preferred as a material for the support.

Examples of the metal include aluminum, iron, nickel, copper, gold, stainless steel, and alloys thereof. Of those, the support is preferably an aluminum support using aluminum, more preferably an aluminum alloy having an oxide film on an outer surface thereof. The presence of the oxide film can suppress the injection of charge from the support, and hence the suppressive effect on the occurrence of the black spot under a high-humidity environment is increased.

In addition, conductivity may be imparted to the resin or the glass through treatment involving, for example, mixing or coating the resin or the glass with a conductive material.

<Conductive Layer>

The conductive layer may be arranged on the support. The arrangement of the conductive layer can conceal flaws and irregularities in the surface of the support, and control the reflection of light on the surface of the support.

The conductive layer preferably contains conductive particles and a resin.

A material for the conductive particles is, for example, a metal oxide, a metal, or carbon black. Examples of the metal oxide include zinc oxide, aluminum oxide, indium oxide, silicon oxide, zirconium oxide, tin oxide, titanium oxide, magnesium oxide, antimony oxide, and bismuth oxide. Examples of the metal include aluminum, nickel, iron, nichrome, copper, zinc, and silver.

Of those, a metal oxide is preferably used as the conductive particles, and in particular, titanium oxide, tin oxide, and zinc oxide are more preferably used.

When the metal oxide is used as the conductive particles, the surface of the metal oxide may be treated with a silane coupling agent or the like, or the metal oxide may be doped with an element, such as phosphorus or aluminum, or an oxide thereof.

In addition, each of the conductive particles may be of a laminated construction having a core particle and a coating layer coating the particle. Examples of the core particle include titanium oxide, barium sulfate, and zinc oxide. The coating layer is, for example, a metal oxide, such as tin oxide.

In addition, when the metal oxide is used as the conductive particles, their volume-average particle diameter is preferably 1 nm or more and 500 nm or less, more preferably 3 nm or more and 400 nm or less.

Examples of the resin include a polyester resin, a polycarbonate resin, a polyvinyl acetal resin, an acrylic resin, a silicone resin, an epoxy resin, a melamine resin, a polyurethane resin, a phenol resin, and an alkyd resin.

In addition, the conductive layer may further contain a concealing agent, such as a silicone oil, resin particles, or titanium oxide.

The conductive layer has an average thickness of preferably 1 μm or more and 50 μm or less, particularly preferably 3 μm or more and 40 μm or less.

The conductive layer may be formed by preparing a coating liquid for a conductive layer containing the above-mentioned materials and a solvent, forming a coat thereof, and drying the coat. Examples of the solvent to be used for the coating liquid include an alcohol-based solvent, a sulfoxide-based solvent, a ketone-based solvent, an ether-based solvent, an ester-based solvent, and an aromatic hydrocarbon-based solvent. As a dispersion method for dispersing the conductive particles in the coating liquid for a conductive layer, there are given methods using a paint shaker, a sand mill, a ball mill, and a liquid collision-type high-speed disperser.

<Undercoat Layer>

The undercoat layer may be arranged on the support or the conductive layer. The arrangement of the undercoat layer can improve an adhesive function between layers to impart a charge injection-inhibiting function.

The undercoat layer preferably contains a resin. In addition, the undercoat layer may be formed as a cured film by polymerizing a composition containing a monomer having a polymerizable functional group.

Examples of the resin include a polyester resin, a polycarbonate resin, a polyvinyl acetal resin, an acrylic resin, an epoxy resin, a melamine resin, a polyurethane resin, a phenol resin, a polyvinyl phenol resin, an alkyd resin, a polyvinyl alcohol resin, a polyethylene oxide resin, a polypropylene oxide resin, a polyamide resin, a polyamide acid resin, a polyimide resin, a polyamide imide resin, and a cellulose resin.

Examples of the polymerizable functional group of the monomer having a polymerizable functional group include an isocyanate group, a blocked isocyanate group, a methylol group, an alkylated methylol group, an epoxy group, a metal alkoxide group, a hydroxyl group, an amino group, a carboxyl group, a thiol group, a carboxylic acid anhydride group, and a carbon-carbon double bond group.

In addition, the undercoat layer may further contain an electron-transporting substance, a metal oxide, a metal, a conductive polymer, and the like for the purpose of improving electric characteristics. Of those, an electron-transporting substance and a metal oxide are preferably used.

Examples of the electron-transporting substance include a quinone compound, an imide compound, a benzimidazole compound, a cyclopentadienylidene compound, a fluorenone compound, a xanthone compound, a benzophenone compound, a cyanovinyl compound, a halogenated aryl compound, a silole compound, and a boron-containing compound. An electron-transporting substance having a polymerizable functional group may be used as the electron-transporting substance and copolymerized with the above-mentioned monomer having a polymerizable functional group to form the undercoat layer as a cured film.

Examples of the metal oxide include indium tin oxide, tin oxide, indium oxide, titanium oxide, zinc oxide, aluminum oxide, and silicon dioxide. Examples of the metal include gold, silver, and aluminum.

In addition, the undercoat layer may further contain an additive.

The average thickness of the undercoat layer is preferably 0.1 μm or more and 50 μm or less, more preferably 0.2 μm or more and 40 μm or less, particularly preferably 0.3 μm or more and 30 μm or less.

The undercoat layer may be formed by preparing a coating liquid for an undercoat layer containing the above-mentioned materials and a solvent, forming a coat thereof, and drying and/or curing the coat. Examples of the solvent to be used for the coating liquid include an alcohol-based solvent, a ketone-based solvent, an ether-based solvent, an ester-based solvent, and an aromatic hydrocarbon-based solvent.

<Photosensitive Layer>

The photosensitive layers of electrophotographic photosensitive members are mainly classified into (1) a laminated photosensitive layer and (2) a single-layer photosensitive layer. (1) The laminated photosensitive layer has a charge-generating layer containing a charge-generating substance and a charge-transporting layer containing a charge-transporting substance. (2) The single-layer photosensitive layer has a photosensitive layer containing both a charge-generating substance and a charge-transporting substance.

(1) Laminated Photosensitive Layer

The laminated photosensitive layer has the charge-generating layer and the charge-transporting layer.

(1-1) Charge-Generating Layer

The charge-generating layer preferably contains the charge-generating substance and a resin.

Examples of the charge-generating substance include azo pigments, perylene pigments, polycyclic quinone pigments, indigo pigments, and phthalocyanine pigments. Of those, azo pigments and phthalocyanine pigments are preferred. Of the phthalocyanine pigments, an oxytitanium phthalocyanine pigment, a chlorogallium phthalocyanine pigment, and a hydroxygallium phthalocyanine pigment are preferred.

The content of the charge-generating substance in the charge-generating layer is preferably 40 mass % or more and 85 mass % or less, more preferably 60 mass % or more and 80 mass % or less with respect to the total mass of the charge-generating layer.

Examples of the resin include a polyester resin, a polycarbonate resin, a polyvinyl acetal resin, a polyvinyl butyral resin, an acrylic resin, a silicone resin, an epoxy resin, a melamine resin, a polyurethane resin, a phenol resin, a polyvinyl alcohol resin, a cellulose resin, a polystyrene resin, a polyvinyl acetate resin, and a polyvinyl chloride resin. Of those, a polyvinyl butyral resin is more preferred.

In addition, the charge-generating layer may further contain an additive, such as an antioxidant or a UV absorber. Specific examples thereof include a hindered phenol compound, a hindered amine compound, a sulfur compound, a phosphorus compound, and a benzophenone compound.

The charge-generating layer has an average thickness of preferably 0.1 μm or more and 1 μm or less, more preferably 0.15 μm or more and 0.4 μm or less.

The charge-generating layer may be formed by preparing a coating liquid for a charge-generating layer containing the above-mentioned materials and a solvent, forming a coat thereof, and drying the coat. Examples of the solvent to be used for the coating liquid include an alcohol-based solvent, a sulfoxide-based solvent, a ketone-based solvent, an ether-based solvent, an ester-based solvent, and an aromatic hydrocarbon-based solvent.

(1-2) Charge-Transporting Layer

The charge-transporting layer preferably contains the charge-transporting substance and a resin.

Examples of the charge-transporting substance include a polycyclic aromatic compound, a heterocyclic compound, a hydrazone compound, a styryl compound, an enamine compound, a benzidine compound, a triarylamine compound, and a resin having a group derived from each of those substances. Of those, a triarylamine compound and a benzidine compound are preferred because the compounds each have a high suppressive effect on the occurrence of the black spot. The content of the charge-transporting substance in the charge-transporting layer is preferably 25 mass % or more and 70 mass % or less, more preferably 30 mass % or more and 55 mass % or less with respect to the total mass of the charge-transporting layer.

Examples of the resin include a polyester resin, a polycarbonate resin, an acrylic resin, and a polystyrene resin. Of those, a polycarbonate resin and a polyester resin are preferred. A polyarylate resin is particularly preferred as the polyester resin.

A content ratio (mass ratio) between the charge-transporting substance and the resin is preferably from 4:10 to 20:10, more preferably from 5:10 to 12:10.

In addition, the charge-transporting layer may contain an additive, such as an antioxidant, a UV absorber, a plasticizer, a leveling agent, a lubricity-imparting agent, or a wear resistance-improving agent. Specific examples thereof include a hindered phenol compound, a hindered amine compound, a sulfur compound, a phosphorus compound, a benzophenone compound, a siloxane-modified resin, a silicone oil, fluorine resin particles, polystyrene resin particles, polyethylene resin particles, silica particles, alumina particles, and boron nitride particles.

The charge-transporting layer has an average thickness of 5 μm or more and 50 μm or less, more preferably 8 μm or more and 40 μm or less, particularly preferably 10 μm or more and 30 μm or less.

The charge-transporting layer may be formed by preparing a coating liquid for a charge-transporting layer containing the above-mentioned materials and a solvent, forming a coat thereof, and drying the coat. Examples of the solvent to be used for the coating liquid include an alcohol-based solvent, a ketone-based solvent, an ether-based solvent, an ester-based solvent, and an aromatic hydrocarbon-based solvent. Of those solvents, an ether-based solvent or an aromatic hydrocarbon-based solvent is preferred.

(2) Single-Layer Photosensitive Layer

The single-layer photosensitive layer may be formed by preparing a coating liquid for a photosensitive layer containing the charge-generating substance, the charge-transporting substance, a resin, and a solvent, forming a coat thereof, and drying the coat. Examples of the charge-generating substance, the charge-transporting substance, and the resin are the same as those of the materials in the section "(1) Laminated Photosensitive Layer."

<Protective Layer>

The configuration of the resin contained in the protective layer and a synthesis method therefor are as described above.

Such protective layer may be formed by, for example, forming a coat of a coating liquid for a protective layer containing the first monomer, the second monomer, and an optional component described below on the photosensitive layer, and curing the coat. As a method of curing the coat, there are given, for example, a thermal polymerization reaction, a photopolymerization reaction, and a radiation polymerization reaction.

An example of the optional component is a solvent. Specific examples of the solvent include an alcohol-based solvent, a ketone-based solvent, an ether-based solvent, a sulfoxide-based solvent, an ester-based solvent, and an aromatic hydrocarbon-based solvent.

Other examples of the optional component include an antioxidant, a UV absorber, a plasticizer, a leveling agent, a lubricity-imparting agent, and a wear resistance-improving agent that may each be contained in the protective layer. Specific examples thereof include a hindered phenol compound, a hindered amine compound, a sulfur compound, a phosphorus compound, a benzophenone compound, a siloxane-modified resin, a silicone oil, fluorine resin particles, polystyrene resin particles, polyethylene resin particles, silica particles, alumina particles, boron nitride particles, titanium oxide, zinc oxide, tin oxide, and indium oxide.

The average thickness of the protective layer is preferably 0.5 μm or more and 10 μm or less, more preferably 1 μm or more and 7 μm or less.

Further, the protective layer preferably has a siloxane structure or a fluoro group for the purpose of enhancing water repellency or for the purpose of suppressing the adhesion of a discharge product due to charging. It is considered that, when the protective layer has the siloxane structure or the fluoro group, which has hydrophobicity, the infiltration of moisture or the discharge product into the protective layer can be reduced.

<Toner>

The toner according to one aspect of the present disclosure is a toner containing toner particles each containing at least a resin, and an external additive. The toner has a volume-average particle diameter of 7 μm or more, and the external additive contains a compound containing a titanium atom.

Examples of the compound containing a titanium atom include titanium oxide and strontium titanate. Of those, strontium titanate is suitably used.

The ratio B of the mass of the compound containing a titanium atom to the total mass of the toner is 0.6 mass % or more. When a surface treatment agent containing a titanium atom is used for the surface of the compound containing a titanium atom, the titanium atom in the surface treatment agent containing a titanium atom is also included in the ratio B. The ratio B may be calculated through, for example, measurement using wavelength-dispersive X-ray fluorescence. When the ratio B falls within the above-mentioned range, the outer surfaces of the toner particles can be brought into a state of being nearly uniformly coated with the external additive.

The volume-average particle diameter of the toner is more preferably 7 μm or more and 11 μm or less, still more preferably 8 μm or more and 10 μm or less.

The toner particles each preferably contain at least one selected from the group consisting of an amorphous polyester resin, a crystalline polyester resin, a styrene-acrylic copolymer, and a styrene-methacrylic copolymer. Of those, a crystalline polyester resin is more preferably contained.

In one aspect of the present disclosure, a polyester resin having a clear endothermic peak (melting point) observed in a reversible specific heat change curve of specific heat change measurement using a differential scanning calorimeter is referred to as crystalline polyester resin, and any other polyester resin is referred to as amorphous polyester resin.

When the crystalline polyester resin is used, the externally added compound containing a titanium atom is easily loosened on the surface of the toner, and hence is easy to uniformly disperse. As a result, even in long-term repeated use, developability is stable, resulting in an increased effect of suppressing the occurrence of the black spot.

The crystalline polyester resin has a high interaction with the compound containing a titanium atom serving as the external additive, making the external additive less liable to be removed from the toner particles even during long-term use, and hence the persistence of the suppressive effect on the occurrence of the black spot is high.

The weight-average molecular weight of the resin forming a binder in each of the toner particles is preferably 5,000 or more and 50,000 or less, more preferably 10,000 or more and 30,000 or less. When the weight-average molecular weight falls within the above-mentioned range, the dispersibility of the compound containing a titanium atom on the surface of the toner is more easily improved.

As the resin contained in each of the toner particles, a styrene-acrylic resin, an amorphous polyester resin, and a crystalline polyester resin may be used, and these resins may be used alone or in combination thereof.

An example of the styrene-acrylic resin is a styrene-butyl acrylate resin or a styrene-butyl methacrylate resin obtained by allowing a styrene monomer and an acrylic monomer to react with each other.

As constituent components of the amorphous polyester resin, there are given an alcohol component that is dihydric or more, and carboxylic acid components, such as a carboxylic acid that is divalent or more, a carboxylic anhydride that is divalent or more, and a carboxylic acid ester that is divalent or more.

With regard to constituent components of the crystalline polyester resin, a condensate of an aliphatic dicarboxylic acid and an aliphatic diol, and an aliphatic monocarboxylic acid and/or an aliphatic monoalcohol is preferred. A condensate of an aliphatic dicarboxylic acid and an aliphatic diol, and an aliphatic monocarboxylic acid is more preferred. The incorporation of the aliphatic monocarboxylic acid and/or the aliphatic monoalcohol as a constituent component of the crystalline polyester resin facilitates the adjustment of the molecular weight and hydroxyl value of the crystalline polyester resin, and besides, allows affinity with a wax to be controlled, and hence is preferred.

The toner particles may contain a wax. Examples of the wax include the following: petroleum-based waxes, such as paraffin wax, microcrystalline wax, and petrolatum, and derivatives thereof; montan wax and a derivative thereof; hydrocarbon waxes by the Fischer-Tropsch process and derivatives thereof; polyolefin waxes, such as polyethylene wax and polypropylene wax, and derivatives thereof; natural waxes, such as carnauba wax and candelilla wax, and derivatives thereof; higher aliphatic alcohols; fatty acids, such as stearic acid and palmitic acid; acid amide waxes; and ester waxes.

Examples of the derivatives include oxides, and block copolymerization products or graft-modified products with vinyl-based monomers.

The content of the wax is preferably 2.0 parts by mass or more and 15.0 parts by mass or less, more preferably 2.0 parts by mass or more and 10.0 parts by mass or less with respect to 100.0 parts by mass of polymerizable monomers capable of generating the binder resin or the binder resin.

The toner particles may each contain a colorant.

As a black colorant, there are given carbon black, a magnetic material, and a colorant toned black using the following yellow, magenta, and cyan colorants.

Examples of the yellow colorant include a condensed azo compound, an isoindolinone compound, an anthraquinone compound, an azo metal complex, a methine compound, and an allylamide compound.

Specific examples thereof include C.I. Pigment Yellow 12, 13, 14, 15, 17, 62, 73, 74, 83, 93, 94, 95, 97, 109, 110, 111, 120, 128, 129, 138, 147, 150, 151, 154, 155, 168, 180, 185, and 214.

Examples of the magenta colorant include a condensed azo compound, a diketopyrrolopyrrole compound, an anthraquinone compound, a quinacridone compound, a basic dye lake compound, a naphthol compound, a benzimidazolone compound, a thioindigo compound, and a perylene compound.

Specific examples thereof include C.I. Pigment Red 2, 3, 5, 6, 7, 23, 48:2, 48:3, 48:4, 57:1, 81:1, 122, 146, 166, 169, 177, 184, 185, 202, 206, 220, 221, 238, 254, and 269, and C.I. Pigment Violet 19.

Examples of the cyan colorant include a copper phthalocyanine compound and a derivative thereof, an anthraquinone compound, and a basic dye lake compound.

Specific examples thereof include C.I. Pigment Blue 1, 7, 15, 15:1, 15:2, 15:3, 15:4, 60, 62, and 66.

The colorants may be used alone or as a mixture thereof, or may be used in a solid solution state. It is appropriate to select the colorant from the viewpoints of a hue angle, chroma, lightness, light fastness, OHP transparency, and dispersibility in the toner.

The content of the colorant is preferably 1 part by mass or more and 20 parts by mass or less with respect to 100 parts by mass of the polymerizable monomers capable of generating the binder resin or the binder resin.

The toner particles may be turned to magnetic toner particles by incorporating a magnetic material thereinto as the colorant. Examples of the magnetic material include: iron oxides, such as magnetite, hematite, and ferrite; metals such as iron, cobalt, and nickel or alloys of these metals with metals such as aluminum, copper, magnesium, tin, zinc, beryllium, calcium, manganese, selenium, titanium, tungsten, and vanadium; and mixtures thereof.

The magnetic material is preferably a magnetic material having a modified surface.

When the magnetic toner particles are prepared by a polymerization method, the magnetic material is preferably one hydrophobized with a surface modifier that is a substance that does not inhibit polymerization. Examples of such surface modifier may include a silane coupling agent and a titanium coupling agent.

The number-average particle diameter of the magnetic material is preferably 2.0 μm or less, more preferably 0.1 μm or more and 0.5 μm or less.

The content of the magnetic material is preferably 20 parts by mass or more and 200 parts by mass or less, more preferably 40 parts by mass or more and 150 parts by mass or less with respect to 100 parts by mass of the polymerizable monomers capable of generating the binder resin or the binder resin.

An example of a production method for producing the toner particles by a pulverization method is described below.

In a raw material-mixing step, the binder resin, the colorant, the wax, and the like serving as constituent materials for the toner are weighed out in predetermined amounts, blended, and mixed.

A mixing apparatus is exemplified by a double cone mixer, a V-type mixer, a drum-type mixer, a super mixer, an FM mixer, a Nauta mixer, and Mechano Hybrid (manufactured by Nippon Coke and Engineering Co., Ltd.).

Next, the mixed materials are melt-kneaded to disperse the colorant, the wax, and the like in the binder resin. In the melt-kneading step, a batch type kneading machine, such as a pressure kneader or a Banbury mixer, or a continuous kneading machine may be used. Because of an advantage in that continuous production can be performed, a single-screw or twin-screw extruder is mainly used. Examples thereof include a KTK-type twin-screw extruder (manufactured by Kobe Steel, Ltd.), a TEM-type twin-screw extruder (manufactured by Toshiba Machine Co., Ltd.), a PCM kneader (manufactured by Ikegai Corp), a twin-screw extruder (manufactured by KCK), a co-kneader (manufactured by BUSS), and Kneadex (manufactured by Nippon Coke & Engineering Co., Ltd.). Further, a resin composition obtained by the melt-kneading is rolled with a two-roll mill or the like, and may be cooled with water or the like in a cooling step.

Then, the resultant cooled product is pulverized in a pulverizing step to a desired particle diameter. In the pulverizing step, for example, the cooled product is coarsely pulverized with a pulverizer, such as a crusher, a hammer mill, or a feather mill. After that, it is appropriate that the coarsely pulverized product be finely pulverized with Kryptron System (manufactured by Kawasaki Heavy Industries, Ltd.), Super Rotor (manufactured by Nisshin Engineering Inc.), Turbo Mill (manufactured by Freund-Turbo Corporation), or a fine pulverizer of an air-jet system.

After that, as required, the pulverized product is classified using a classifier or a sieving machine, such as Elbow-Jet (manufactured by Nittetsu Mining Co., Ltd.) of an inertial classification system, Turboplex (manufactured by Hosokawa Micron Corporation) of a centrifugal force classification system, TSP Separator (manufactured by Hosokawa Micron Corporation), or Faculty (manufactured by Hosokawa Micron Corporation). Thus, the toner is obtained.

In addition, the toner particles may be spheroidized. For example, after the pulverization, it is appropriate that the pulverized product be spheroidized using Hybridization System (manufactured by Nara Machinery Co., Ltd.), Mechanofusion System (manufactured by Hosokawa Micron Corporation), Faculty (manufactured by Hosokawa Micron Corporation), or Meteorainbow MR Type (manufactured by Nippon Pneumatic Mfg. Co., Ltd.).

The toner particles are mixed with any other external additive as required. Thus, the toner according to one aspect of the present disclosure may be obtained. As a mixer for mixing the external additive, there are given FM Mixer (manufactured by Nippon Coke & Engineering Co., Ltd.), Super Mixer (manufactured by Kawata Mfg. Co., Ltd.), Nobilta (manufactured by Hosokawa Micron Corporation), and Hybridizer (manufactured by Nara Machinery Co., Ltd.).

In addition, after the mixing with the external additive, the coarse particles may be sieved. As a sieving apparatus to be used for that purpose, there are given: Ultrasonic (manufactured by Koei Sangyo Co., Ltd.); Resonasieve and Gyro-Sifter (manufactured by Tokuju Corporation); Vibrasonic System (manufactured by Dalton Corporation); Soniclean (manufactured by Shintokogio Ltd.); Turbo Screener (manufactured by Freund-Turbo Corporation); and Microsifter (manufactured by Makino mfg Co., Ltd.).

In order to improve the chargeability of the toner particles, an external additive for improving chargeability may be added.

The following may be used as the external additive for improving chargeability.

There are given, for example: fluorine-based resin powders, such as vinylidene fluoride fine powder and polytetrafluoroethylene fine powder; silica fine particles, such as wet process silica and dry process silica, titanium oxide fine particles, and alumina fine particles; hydrophobized fine particles obtained by subjecting these fine particles to surface treatment with a hydrophobizing agent, such as a silane compound, a titanium coupling agent, or a silicone oil; oxides, such as zinc oxide and tin oxide; multiple oxides, such as strontium titanate, barium titanate, calcium titanate, strontium zirconate, and calcium zirconate; and carbonate compounds, such as calcium carbonate and magnesium carbonate. Of those, titanium oxide fine particles and strontium titanate uniformly cover the entire surfaces of the toner particles to reduce the electrostatic interaction between the photosensitive member and the toner, and hence increase the suppressive effect on the occurrence of the black spot.

Of those, dry process silica fine particles, which are fine particles produced through the vapor phase oxidation of a silicon halide compound, and which are called dry process silica or fumed silica, are preferred.

The dry process utilizes, for example, a thermal decomposition oxidation reaction in an oxyhydrogen flame of a silicon tetrachloride gas, and a basic reaction formula therefor is as follows.

$$SiCl_4+2H_2+O_2 \rightarrow SiO_2+4HCl$$

In this production process, composite fine particles of silica and any other metal oxide may also be obtained by using any other metal halide compound, such as aluminum chloride or titanium chloride, together with the silicon halide compound, and the silica fine particles encompass the composite fine particles as well.

The external additive for improving chargeability preferably has a number-average particle diameter of primary particles of 5 nm or more and 30 nm or less because high chargeability can be imparted.

Further, the silica fine particles are more preferably hydrophobized silica fine particles subjected to surface treatment with the above-mentioned hydrophobizing agent.

The external additive for improving chargeability preferably has a specific surface area based on nitrogen adsorption measured by a BET method of 30 $m^2/g$ or more and 300 $m^2/g$ or less.

With regard to the content of the external additive for improving chargeability, the total amount of the external additive for improving chargeability is preferably 0.6 mass % or more with respect to 100 parts by mass of the toner.

[Electrophotographic Apparatus and Process Cartridge]

An electrophotographic apparatus according to one aspect of the present disclosure includes the electrophotographic photosensitive member described above, a charging device, an exposing device, a developing device, and a transferring device.

A process cartridge according to one aspect of the present disclosure integrally supports the electrophotographic photosensitive member described in the foregoing, and at least one device selected from the group consisting of a charging device, a developing device, a transferring device, and a cleaning device, and is removably mounted onto the main body of an electrophotographic apparatus.

An example of the schematic configuration of an electrophotographic apparatus including a process cartridge 11 including an electrophotographic photosensitive member is illustrated in FIGURE.

A cylindrical electrophotographic photosensitive member 1 is rotationally driven about a shaft 2 in a direction indicated by the arrow at a predetermined peripheral speed. The surface of the electrophotographic photosensitive member 1 is charged to a predetermined positive or negative potential by a charging device 3. In FIGURE, a roller charging system based on a roller-type charging member is illustrated, but a charging system such as a corona charging system, a proximity charging system, or an injection charging system may be adopted.

The charged surface of the electrophotographic photosensitive member 1 is irradiated with exposure light 4 from an exposing device (not shown), and hence an electrostatic latent image corresponding to target image information is formed thereon. The electrostatic latent image formed on the surface of the electrophotographic photosensitive member 1 is developed by supplying a toner stored in a developing device 5, and a toner image is formed on the surface of the electrophotographic photosensitive member 1. The toner image formed on the surface of the electrophotographic photosensitive member 1 is transferred onto a transfer material 7 by a transferring device 6. The transfer material 7 onto which the toner image has been transferred is conveyed to a fixing device 8, is subjected to treatment for fixing the toner image, and is printed out to the outside of the electrophotographic apparatus. The electrophotographic apparatus may include a cleaning device 9 for removing a deposit, such as the toner remaining on the surface of the electrophotographic photosensitive member 1 after the transfer. The cleaning device is preferably a cleaning blade containing a urethane resin. In addition, a so-called cleanerless system configured to remove the deposit with the developing device or the like without separate arrangement of the cleaning device may be used. The electrophotographic apparatus may include an electricity-removing mechanism configured to subject the surface of the electrophotographic photosensitive member 1 to electricity-removing treatment with pre-exposure light 10 from a pre-exposing device (not shown). In addition, a guiding device 12, such as a rail, may be arranged for removably mounting a process cartridge 11 according to one aspect of the present disclosure onto the main body of an electrophotographic apparatus.

The electrophotographic photosensitive member according to one aspect of the present disclosure can be used in, for example, a laser beam printer, an LED printer, a copying machine, a facsimile, and a multifunctional peripheral thereof.

According to one aspect of the present disclosure, the electrophotographic apparatus which is capable of suppressing the occurrence of a black spot over a long period of time even under a low-temperature and low-humidity environment can be obtained. According to another aspect of the present disclosure, the process cartridge which contributes to suppression of the occurrence of a black spot over a long period of time even under a low-temperature and low-humidity environment can be obtained.

EXAMPLES

The electrophotographic apparatus and the like according to one aspect of the present disclosure are described in more detail below by way of Examples and Comparative Examples. The present disclosure is by no means limited to configurations embodied in the following Examples, and various modifications may be made without departing from the gist of the present disclosure. In the description in the following Examples and Comparative Examples, "part(s)" is by mass unless otherwise specified.

<Production of Toner>

Production of Styrene-Acrylic Resin A

The following materials were placed in a reaction vessel with a reflux condenser, a stirrer, and a nitrogen inlet tube under a nitrogen atmosphere.

| Material | Blending amount |
|---|---|
| Styrene | 79.0 parts |
| Toluene | 100.0 parts |
| n-Butyl acrylate | 20.0 parts |
| Acrylic acid | 1.0 part |
| Di-t-butyl peroxide (PBD) | 7.2 parts |

The contents of the vessel were stirred at 200 rotations per minute, heated to 110° C., and stirred for 10 hours. Further, the contents were heated to 140° C. and polymerized for 6 hours. The solvent was removed by evaporation to give a styrene-acrylic resin A having a weight-average molecular weight (Mw) of 26,000 and a glass transition point of 73° C.

Production Example of Toner 1

The following materials were mixed well in a Henschel mixer ("Model FM-75", manufactured by Mitsui Miike Chemical Engineering Machinery, Co., Ltd.), and then kneaded in a twin-screw kneader ("Model PCM-30", manufactured by Ikegai Ironworks Corp) set to a temperature of 125° C. The resultant kneaded product was slowly cooled to room temperature. After that, the resultant was coarsely pulverized with a cutter mill, pulverized using a fine pulverizer making use of a jet stream, and air-classified to produce "toner base particles" having a volume-average particle diameter of 7 μm.

| | |
|---|---|
| Styrene-acrylic resin A | 100.0 parts |
| Carbon black (product name: Printex 35; manufactured by Orion Engineered Carbons) | 7.0 parts |
| Synthetic wax (product name: Sasol Spray 30; manufactured by Schumann Sasol, melting point: 98° C.) | 3.0 parts |
| Magnetic material | 4.0 parts |

The coarsely pulverized product was finely pulverized using a collision type airflow pulverizer making use of a high-pressure gas. Next, through classification with an air classifier utilizing a Coanda effect, fine powder and coarse powder were simultaneously classified and removed to provide "toner base particles" having a volume-average particle diameter of 7 μm.

To 98.2 parts of the resultant toner base particles, 0.6 part by mass of titanium oxide fine particles having been subjected to surface treatment with 15.0 mass % of isobutyltrimethoxysilane and having a number-average particle diameter of primary particles of 50 nm, and 1.8 parts by mass of hydrophobic silica fine particles having been subjected to surface treatment with 20.0 mass % of hexamethyldisilazane and having a number-average particle diameter of primary particles of 16 nm were added, and the particles were mixed in a Henschel mixer (Model FM-75 manufactured by Mitsui Miike Chemical Engineering Machinery, Co., Ltd.) to provide a "toner 1".

Production Example of Toner 2

A "toner 2" having a volume-average particle diameter of 7 μm was obtained in the same manner as in the production example of the toner 1 except that, in the production example of the toner 1, the addition amount of the 50 nm titanium oxide fine particles was changed to 1.3 parts by mass.

Production Example of Amorphous Polyester Resin A

A reaction vessel with a nitrogen inlet tube, a dehydration tube, a stirrer, and a thermocouple was loaded with 30.0 mol % of terephthalic acid, 10.0 mol % of trimellitic acid, 10.0 mol % of fumaric acid, 25.0 mol % of a polyoxypropylene 2 mol adduct of bisphenol A, and 25.0 mol % of a polyoxyethylene 2 mol adduct of bisphenol A, and then 1.5 parts by mass of dibutyltin was added as a catalyst with respect to 100 parts by mass of the total amount of the monomers.

Then, under a nitrogen atmosphere, the temperature was quickly increased to 180° C. at normal pressure, and then polycondensation was performed by evaporating water under heating from 180° C. to 210° C. at a rate of 10° C./hour. After the temperature had reached 210° C., the pressure in the reaction vessel was reduced to 5 kPa or less, and polycondensation was performed under the conditions of 210° C. and 5 kPa or less to provide an amorphous polyester resin A having a weight-average molecular weight (Mw) of 16,000 and a glass transition point of 63° C.

Production Example of Toner 3

Materials shown below were mixed well in a Henschel mixer, and then kneaded in a twin-screw kneader set to a temperature of 140° C. The resultant kneaded product was cooled and coarsely pulverized to 1 mm or less with a hammer mill to provide a coarsely pulverized product.

| | |
|---|---|
| Amorphous polyester resin A | 100.0 parts |
| Polyethylene wax (melting point: 97° C.) | 7.0 parts |
| Metal compound of dialkylsalicylic acid | 1.0 part |
| Carbon black | 7.0 parts |
| Magnetic material | 4.0 parts |

The coarsely pulverized product was finely pulverized using a collision type airflow pulverizer making use of a high-pressure gas. Next, through classification with an air classifier utilizing a Coanda effect ("ELBOW-JET LABO EJ-L3", manufactured by Nittetsu Mining Co., Ltd.), fine powder and coarse powder were simultaneously classified and removed to provide "toner base particles" having a volume-average particle diameter of 7 μm.

To 98.2 parts by mass of the resultant toner base particles, 1.3 parts by mass of titanium oxide fine particles having been subjected to surface treatment with 15.0 mass % of isobutyltrimethoxysilane and having a number-average particle diameter of primary particles of 50 nm, and 1.8 parts by mass of hydrophobic silica fine particles having been subjected to surface treatment with 20.0 mass % of hexamethyldisilazane and having a number-average particle diameter of primary particles of 16 nm were added, and the particles were mixed in a Henschel mixer to provide a "toner 3".

Production Example of Crystalline Polyester Resin B

A reaction vessel with a nitrogen inlet tube, a dehydration tube, a stirrer, and a thermocouple was loaded with 50.0 mol % of 1,10-decanediol as an alcohol monomer and 50.0 mol % of sebacic acid as a carboxylic acid monomer. Then, 1 part by mass of tin dioctoate was added as a catalyst with respect to 100 parts by mass of the total amount of the monomers, and the inside of the reaction vessel was heated under a nitrogen atmosphere to 140° C., followed by a reaction for 6 hours while water was evaporated from inside the reaction vessel under normal pressure.

Then, the monomers were allowed to react while the temperature in the reaction vessel was increased to 200° C. at a temperature increase rate of 10° C./hour, and were further allowed to react for 2 hours after the temperature in the reaction vessel had reached 200° C. After that, the pressure in the reaction vessel was reduced to 5 kPa or less, followed by a reaction at 200° C. for 6 hours to provide a crystalline polyester resin B having a weight-average molecular weight (Mw) of 19,000 and a melting point of 76° C.

Production Example of Toner 4

A "toner 4" was obtained in the same manner as in the production example of the toner 3 except that, in the production example of the toner 3, the amount of the amorphous polyester resin A was changed to 90.0 parts by mass and 10.0 parts by mass of the crystalline polyester resin B was added.

Production Examples of Toners 5 to 10

"Toners 5 to 10" were obtained in the same manner as in the production example of the toner 4 except that, in the production example of the toner 4, the volume-average particle diameter of the toner base particles, the compound containing a titanium atom, and the ratio of the mass of the compound containing a titanium atom to the total mass of the toner were changed as shown in Table 1.

Production Examples of Comparative Toners 1 and 2

Comparative toners 1 and 2 were obtained in the same manner as in the production example of the toner 4 except that, in the production example of the toner 4, the volume-average particle diameter of the toner base particles, the compound containing a titanium atom, and the ratio of the mass of the compound containing a titanium atom to the total mass of the toner were changed as shown in Table 1.

Measurement of Volume-Average Particle Diameter of Toner

"Coulter Counter TA-II" or "Coulter Multisizer II" (each of which is a product name, manufactured by Coulter) may be used as a measurement apparatus. An aqueous solution containing about 1% of NaCl is used as an electrolytic solution. For the electrolytic solution, an electrolytic solution prepared using first grade sodium chloride, or for example, ISOTON (trademark)-II (manufactured by Coulter Scientific Japan) may be used.

As a measurement method, 0.1 ml to 5 ml of a surfactant (preferably an alkylbenzene sulfonate) is added as a dispersant into 100 ml to 150 ml of the electrolytic aqueous solution, and 2 mg to 20 mg of a measurement sample is further added. The electrolytic solution in which the sample is suspended is subjected to dispersion treatment with an ultrasonic disperser for from about 1 minute to about 3 minutes, and the volume of the sample is measured with the measurement apparatus using, as an aperture, a 100 μm aperture for each channel to calculate the volume distribution of the sample. The volume-average particle diameter of the sample is determined from the resultant volume distribution.

As the channels, the following thirteen channels are used: 2.00 μm to 2.52 μm; 2.52 μm to 3.17 μm; 3.17 μm to 4.00 μm; 4.00 μm to 5.04 μm; 5.04 μm to 6.35 μm; 6.35 μm to 8.00 μm; 8.00 μm to 10.08 μm; 10.08 μm to 12.70 μm; 12.70 μm to 16.00 μm; 16.00 μm to 20.20 μm; 20.20 m to 25.40 μm; 25.40 μm to 32.00 μm; and 32 μm to 40.30 μm.

The following method was utilized as a method of identifying the compound containing a titanium atom and calculating its content.

X-Ray Fluorescence Analysis Conditions

Apparatus name: A fully automatic wavelength-dispersive X-ray fluorescence analysis apparatus (product name: Axios advanced, manufactured by Malvem Panalytical)

Analysis Conditions

Quantification method: fundamental parameter method (FP method);

Analysis element: B to U;

Measurement atmosphere: vacuum;

Measurement sample: solid;

Collimator mask diameter: 27 mm;

Measurement conditions: An automatic program preset to an excitation condition optimum for each element was used.

Measurement time: About 20 minutes.

For other conditions, general values recommended for the apparatus were used.

Sample Pretreatment

About 3 g of toner is placed in a ring made of vinyl chloride and having a diameter of 27 mm, and pressed at 200 kN to mold a sample. The weight and thickness of the toner used are recorded.

Analysis

Analysis program: SpectraEvaluation (version 5.0L);

Analysis condition: oxide form;

Balance component: CH2;

(The CHO ratio of the resin is measured in advance by using an analysis technique, such as NMR, and is used as the balance.)

For others conditions, general values recommended for the apparatus were used.

Details of Analysis Conditions

Analyzing crystals: LiF220, LiF200, Ge111, TIAP, and PX1

Tube current: Changed within the range of from 40 mA to 80 mA for each element.

Tube voltage: Changed within the range of from 30 kV to 60 kV for each element.

*The product of the tube current and the tube voltage is constantly kept at 2.4 kW.

Bulb filter: Brass (400 μm) was used depending on the element.

In the case of containing strontium titanate particles as the compound containing a titanium atom, Sr/Ti (mass ratio) is determined excluding oxygen from the results of the above-mentioned quantification, and then converted to Sr/Ti (molar ratio) based on the atomic weight of each element.

A sample to be used is obtained by isolating the compound containing a titanium atom from the toner including the external additive.

TABLE 1

| Toner | Resin | Volume-average particle diameter/ μm | Compound containing titanium atom Kind | Compound containing titanium atom Mass % |
|---|---|---|---|---|
| Toner 1 | Styrene-acrylic resin | 7 | $TiO_2$ | 0.6 |
| Toner 2 | Styrene-acrylic resin | 7 | $TiO_2$ | 1.3 |
| Toner 3 | Amorphous polyester resin | 7 | $TiO_2$ | 1.3 |
| Toner 4 | Amorphous polyester resin/crystalline polyester resin | 7 | $TiO_2$ | 1.3 |
| Toner 5 | Amorphous polyester resin/crystalline polyester resin | 8.5 | $TiO_2$ | 0.6 |
| Toner 6 | Amorphous polyester resin/crystalline polyester resin | 8.5 | $TiO_2$ | 0.9 |
| Toner 7 | Amorphous polyester resin/crystalline polyester resin | 9.5 | $TiO_2$ | 1.2 |
| Toner 8 | Amorphous polyester resin/crystalline polyester resin | 10.5 | $TiO_2$ | 0.9 |
| Toner 9 | Amorphous polyester resin/crystalline polyester resin | 8.5 | $SrTiO_3$ | 0.9 |
| Toner 10 | Amorphous polyester resin/crystalline polyester resin | 8.5 | $SrTiO_3$/ $TiO_2$ = 1:1 | 0.9 |

TABLE 1-continued

| Toner | Resin | Volume-average particle diameter/ μm | Compound containing titanium atom Kind | Compound containing titanium atom Mass % |
|---|---|---|---|---|
| Comparative Toner 1 | Amorphous polyester resin/crystalline polyester resin | 8.5 | $TiO_2$ | 0.5 |
| Comparative Toner 2 | Amorphous polyester resin/crystalline polyester resin | 6.7 | $TiO_2$ | 0.6 |

<Production of Each Layer of Electrophotographic Photosensitive Member>

Support 1:

A cylinder (JIS-A3003, aluminum alloy) formed of an aluminum alloy having an outer diameter of 30 mm, a length of 254 mm, and a thickness of 0.9 mm, whose surface had been roughly cut, was mounted onto an NC lathe, and subjected to tool bit cutting processing under conditions described below with an appropriate diamond sintered tool bit so as to have an outer diameter of 23.97 mm and a surface roughness Ra(S80) of 0.02 μm, while the abutting angle of the diamond sintered tool bit with respect to an element tube was changed between 0° and 3°, to thereby produce a support.

The tool bit cutting processing was performed under the following conditions: the number of main axis revolutions of the lathe was set to 3,000 rpm, and the moving speed of the tool bit (tool bit feed rate) was changed with a program for repeatedly increasing and decreasing the feed rate so as to change the feed rate by 0.005 mm/revolution every 1.5 mm of processing distance between 0.340 mm/revolution and 0.360 mm/revolution.

ΔL on the outer peripheral surface of the support was measured to be 50 m.

ΔL was measured as described above using a profile curve of the outer peripheral surface of the support near its center obtained by roughness measurement performed with "Surfcom 1400D" (manufactured by Tokyo Seimitsu Co., Ltd.) in accordance with the JIS1994 standard under the measurement conditions of a measurement length of 4.0 mm, a long wavelength cutoff λc of 0.8 mm (Gaussian), and a measurement speed of 0.3 mm/sec.

In addition, Ra(S80) is an arithmetic average roughness Ra obtained near the center of the outer peripheral surface of the support by roughness measurement performed with "Surfcom 1400D" (manufactured by Tokyo Seimitsu Co., Ltd.) in accordance with the JIS'01 standard under the measurement conditions of a measurement length of 4.0 mm, a long wavelength cutoff λc of 0.8 mm (Gaussian), a short wavelength cutoff λs of 80 μm, and a measurement speed of 0.3 mm/sec.

Support 2:

A cylinder (JIS-A3003, aluminum alloy) formed of an aluminum alloy having an outer diameter of 30 mm, a length of 254 mm, and a thickness of 0.9 mm, whose surface had been roughly cut, was subjected to anodization treatment, and then subjected to sealing treatment with a sealing agent containing nickel acetate as a main component to form an anodized film (alumite film) having a thickness of about 4.2 μm, to thereby produce a support (conductive support).

Coating Liquid 1 for Undercoat Layer:

A coating liquid for an undercoat layer was produced as described below. Rutile-type titanium oxide having an average primary particle diameter of 40 nm ("TTO55N" manufactured by Ishihara Sangyo Kaisha, Ltd.), and 3 mass % of methyldimethoxysilane ("TSL8117" manufactured by Toshiba Silicone Co., Ltd.) with respect to the titanium oxide were mixed in a Henschel mixer, and the resultant surface-treated titanium oxide was dispersed in a mixed solvent having a weight ratio of methanol/1-propanol of 7/3 with a ball mill to prepare a dispersed slurry of the surface-treated titanium oxide.

The dispersed slurry, and a mixed solvent of methanol/1-propanol/toluene and pellets of copolymerized polyamide formed of ε-caprolactam (compound represented by the following formula (D))/bis(4-amino-3-methylcyclohexyl) methane (compound represented by the following formula (E))/hexamethylenediamine (compound represented by the following formula (F))/decamethylenedicarboxylic acid (compound represented by the following formula (G))/octadecamethylenedicarboxylic acid (compound represented by the following formula (H)) at a compositional molar ratio of 60%/15%/5%/15%/5% were stirred and mixed while being heated to dissolve the polyamide pellets, followed by ultrasonic dispersion treatment to produce a coating liquid 1 for an undercoat layer having a weight ratio of methanol/1-propanol/toluene of 7/1/2, containing surface-treated titanium oxide/copolymerized polyamide at a weight ratio of 3/1, and having a solid content concentration of 18.0%.

(D)

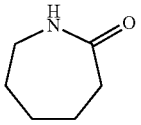

(E)

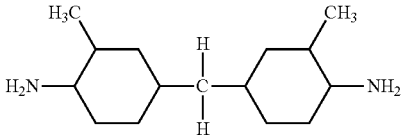

(F)

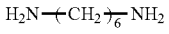

(G)

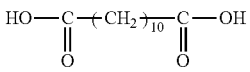

-continued (H)

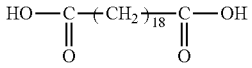

Coating Liquid 1 for Charge-Generating Layer:

10 Parts of a Y-type oxytitanium phthalocyanine crystal having a strong peak at a Bragg angle (2θ±0.2°) in CuKα characteristic X-ray diffraction of 27.3° serving as a charge-generating substance, and 150 parts of 4-methoxy-4-methylpentanone-2 were placed in a sand mill using glass beads each having a diameter of 1 mm, and subjected to pulverization and dispersion treatment with a sand grind mill for 1.5 hours.

Next, 105 parts of a solution of 5 parts of a polyacetal resin (product name: S-LEC BX-1, manufactured by Sekisui Chemical Co., Ltd.) added and dissolved in 100 parts of 4-methoxy-4-methylpentanone-2 in advance was added, and the resultant mixture was subjected to dispersion treatment for 0.5 hour.

After that, 250 parts of 1,2-dimethoxyethane was added to produce a coating liquid 1 for a charge-generating layer.

Measurement of X-ray diffraction was performed under the following conditions.

[Powder X-Ray Diffraction Measurement]

Used measurement device: X-ray diffractometer RINT-TTR II, manufactured by Rigaku Corporation X-ray tube: Cu Tube voltage: 50 KV Tube current: 300 mA Scanning method: 2θ/θ scan Scanning speed: 4.0°/min Sampling interval: 0.02°

Start angle (2θ): 5.0°

Stop angle (2θ): 40.0°

Attachment: standard sample holder

Filter: not used

Incident monochromator: used

Counter monochromator: not used

Divergence slit: open

Divergence vertical limit slit: 10.00 mm

Scattering slit: open

Receiving slit: open

Plate monochromator: used

Counter: scintillation counter

Coating Liquid 1 for Charge-Transporting Layer:

10 Parts of a charge-transporting substance (hole-transportable substance) represented by the following structural formula (CTM-1), and 10 parts of a polycarbonate resin having copolymerization units represented by the structural formula (PC-1) and the structural formula (PC-2) (PC-1/PC-2=90/10, Mv=40,000) were dissolved in a mixed solvent of 55 parts of toluene and 45 parts of tetrahydrofuran to produce a coating liquid 1 for a charge-transporting layer.

(CTM-1)

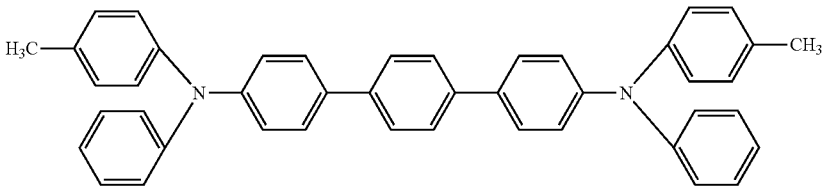

-continued (PC-1)

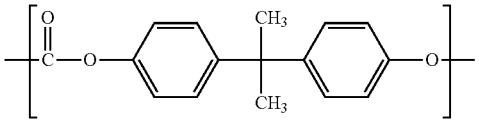

Coating Liquid 2 for Charge-Transporting Layer:

A coating liquid 2 for a charge-transporting layer was produced in the same manner as the coating liquid 1 for a charge-transporting layer except that, in the coating liquid 1 for a charge-transporting layer, the structural formula (CTM-1) was changed to the following structural formula (CTM-2).

(CTM-2)

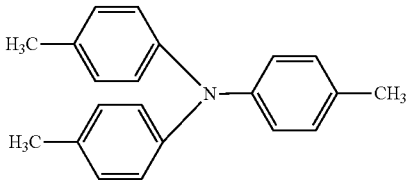

Coating Liquid 3 for Charge-Transporting Layer:

A coating liquid 3 for a charge-transporting layer was produced in the same manner as the coating liquid 1 for a charge-transporting layer except that, in the coating liquid 1 for a charge-transporting layer, the structural formula (CTM-1) was changed to the following structural formula (CTM-3).

(CTM-3)

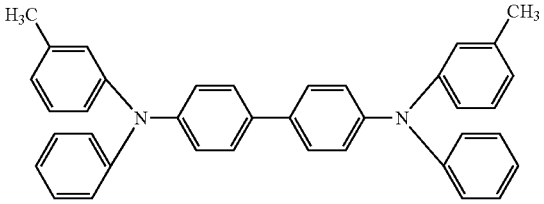

Coating Liquid 4 for Charge-Transporting Layer:

A coating liquid 4 for a charge-transporting layer was produced in the same manner as the coating liquid 1 for a charge-transporting layer except that, in the coating liquid 1 for a charge-transporting layer, the structural formula (CTM-1) was changed to the structural formula (CTM-4).

(CTM-4)

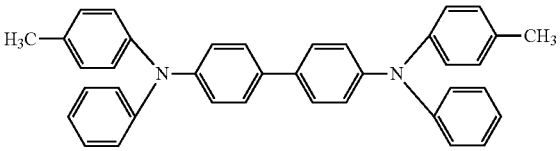

(PC-2)

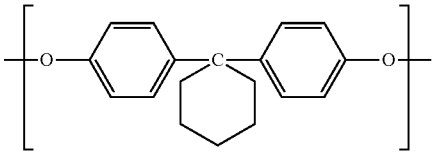

Coating Liquid 1 for Protective Layer:

The following compounds were prepared.

| | |
|---|---|
| Compound represented by the structural formula (OCL-1) | 10 parts |
| Compound represented by the structural formula (L-1) | 2.5 parts |
| 1-Hydroxycyclohexyl phenyl ketone represented by the structural formula (I) | 1 part |
| Siloxane-modified acrylic compound (product name: BYK-3550, manufactured by BYK Japan KK) | 0.2 part |

Those compounds were mixed with a mixed solvent of 72 parts of 2-propanol and 8 parts of tetrahydrofuran, and the mixture was stirred. Thus, a coating liquid 1 for a protective layer was prepared.

(I)

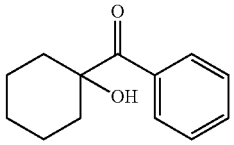

Coating Liquid 2 for Protective Layer: A coating liquid 2 for a protective layer was produced in the same manner as the coating liquid 1 for a protective layer except that, in the coating liquid 1 for a protective layer, the amount of the compound represented by the structural formula (L-1) was changed to 6.6 parts.

Coating Liquids 3 to 17 for Protective Layers:

Coating liquids 3 to 17 for protective layers were each produced in the same manner as the coating liquid 1 for a protective layer except that, in the coating liquid 1 for a protective layer, the coating liquid was produced by changing the triphenylamine compound and the compound containing the structure represented by the general formula (1) or (2) as shown in Table 2.

Coating Liquid 18 for Protective Layer:

A coating liquid 18 for a protective layer was produced in the same manner as the coating liquid 1 for a protective layer except that, in the coating liquid 1 for a protective layer, the structural formula (L-2) was changed to the structural formula (P-1).

(P-1)

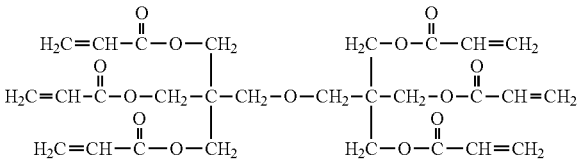

TABLE 2

| Coating liquid for protective layer | Triphenylamine compound | | Compound containing structure represented by general formula (1) or (2) | |
|---|---|---|---|---|
| | Structure | Content (parts) | Structure | Content (parts) |
| Coating liquid 1 for protective layer | OCL-1 | 10 | L-1 | 2.5 |
| Coating liquid 2 for protective layer | OCL-1 | 10 | L-1 | 6.6 |
| Coating liquid 3 for protective layer | OCL-1 | 10 | L-2 | 5.8 |
| Coating liquid 4 for protective layer | OCL-1 | 10 | L-2 | 28 |
| Coating liquid 5 for protective layer | OCL-1 | 10 | L-2 | 7.9 |
| Coating liquid 6 for protective layer | OCL-1 | 10 | L-2 | 10 |
| Coating liquid 7 for protective layer | OCL-1 | 10 | L-2 | 14.7 |
| Coating liquid 8 for protective layer | OCL-4 | 10 | L-6 | 5.8 |
| Coating liquid 9 for protective layer | OCL-4 | 10 | L-6 | 7.9 |
| Coating liquid 10 for protective layer | OCL-4 | 10 | L-6 | 10 |
| Coating liquid 11 for protective layer | OCL-4 | 10 | L-6 | 14.7 |
| Coating liquid 12 for protective layer | OCL-4 | 10 | L-6 | 28 |
| Coating liquid 13 for protective layer | OCL-1 | 10 | L-4 | 2.5 |
| Coating liquid 14 for protective layer | OCL-1 | 10 | L-4 | 3.7 |
| Coating liquid 15 for protective layer | OCL-1 | 10 | L-4 | 6.6 |
| Coating liquid 16 for protective layer | OCL-1 | 10 | L-2 | 5 |
| Coating liquid 17 for protective layer | OCL-1 | 10 | L-2 | 34 |
| Coating liquid 18 for protective layer | OCL-1 | 10 | P-1 | 5 |

<Production of Electrophotographic Photosensitive Member>

Production of Photosensitive Member 1

The coating liquid 1 for an undercoat layer was applied onto the support 1 by dip coating, and dried at 100° C. for 10 minutes so as to have a dry thickness of 2.0 μm, to thereby form an undercoat layer.

The coating liquid 1 for a charge-generating layer was applied onto the resultant undercoat layer by dip coating, and dried at 100° C. for 10 minutes so as to have a dry thickness of 0.15 μm, to thereby form a charge-generating layer.

The coating liquid 1 for a charge-transporting layer was applied onto the resultant charge-generating layer by dip coating, and dried at 120° C. for 30 minutes so as to have a dry thickness of 16.0 μm, to thereby form a charge-transporting layer.

The coating liquid 1 for a protective layer was applied onto the resultant charge-transporting layer by dip coating to form a coat so that its dry thickness was 3.0 m, and the resultant coat was dried at 50° C. for 6 minutes. After that, through the use of an electrodeless lamp H bulb (manufactured by Heraeus), the coat was irradiated with UV light for 10 seconds under the condition of a lamp intensity of 0.6 W/cm$^2$ while the support (object to be irradiated) was rotated at a speed of 300 Rpm. Next, the coat was naturally cooled until its temperature became 25° C., and then the coat was subjected to heating treatment for 1 hour under such a condition that its temperature became 125° C., to thereby form a protective layer having a thickness of 3 μm. Thus, a photosensitive member 1 was produced.

With the use of the produced photosensitive member 1, the ratio A of the content of the structure represented by the general formula (1') to the total mass of the protective layer was calculated under the following conditions.

The surface of the obtained photosensitive member was shaved off with a razor to peel off the protective layer, and its mass was measured. The protective layer was immersed in chloroform and ultrasonicated with an ultrasonic apparatus for 1 hour. After that, the protective layer that was insoluble in chloroform was taken out and dried, and then subjected to measurement by pyrolysis-GCMS according to the following procedure. A TMAH methylating agent and the sample were pyrolyzed with a pyrolyzer (product name: JPS-700, manufactured by Japan Analytical Industry Co., Ltd.), and the sample was introduced into a GCMS (product name: ISQ (FOCUS GC), manufactured by Thermo Fisher Scientific) and analyzed. In addition, similar analysis was also performed in the case of using no TMAH methylating agent. In this measurement, a triphenylamine structure and an acryloyloxy group or a methacryloyloxy group were detected. In addition, a calibration curve was drawn using commercially available authentic samples in the analysis using no TMAH methylating agent, to thereby determine the content of the structure represented by the general formula (1') with respect to the total mass of the protective layer and calculate the ratio A.

Photosensitive Members 2 to 24:

Photosensitive members 2 to 24 were each produced in the same manner as the photosensitive member 1 except that, in the photosensitive member 1, the photosensitive member was produced by changing the coating liquid for an undercoat layer, the coating liquid for a charge-generating layer, the coating liquid for a charge-transporting layer, and the coating liquid for a protective layer as shown in Table 3.

Comparative Photosensitive Members 1 to 3:

Comparative photosensitive members 1 to 3 were each produced in the same manner as the photosensitive member 1 except that, in the photosensitive member 1, the photosensitive member was produced by changing the coating liquid for an undercoat layer, the coating liquid for a charge-generating layer, the coating liquid for a charge-transporting layer, and the coating liquid for a protective layer as shown in Table 3.

In addition, the ratio A of the content of the structure represented by the general formula (1') or (2') to the total mass of the protective layer was calculated by the same method as with the photosensitive member 1.

TABLE 3

| Photosensitive member | Support | Coating liquid for undercoat layer | Coating liquid for charge-generating layer | Coating liquid for charge-transporting layer | Coating liquid for protective layer | Ratio A |
|---|---|---|---|---|---|---|
| Photosensitive member 1 | 1 | 1 | 1 | 1 | 1 | 10 |
| Photosensitive member 2 | 1 | 1 | 1 | 1 | 2 | 20 |
| Photosensitive member 3 | 1 | 1 | 1 | 2 | 1 | 10 |
| Photosensitive member 4 | 1 | 1 | 1 | 2 | 2 | 20 |
| Photosensitive member 5 | 2 | — | 1 | 1 | 3 | 10 |
| Photosensitive member 6 | 2 | — | 1 | 1 | 4 | 20 |
| Photosensitive member 7 | 2 | — | 1 | 2 | 3 | 10 |
| Photosensitive member 8 | 2 | — | 1 | 2 | 4 | 20 |
| Photosensitive member 9 | 2 | — | 1 | 3 | 3 | 10 |
| Photosensitive member 10 | 2 | — | 1 | 3 | 4 | 20 |
| Photosensitive member 11 | 2 | — | 1 | 4 | 3 | 10 |
| Photosensitive member 12 | 2 | — | 1 | 4 | 5 | 12 |
| Photosensitive member 13 | 2 | — | 1 | 4 | 6 | 13.6 |
| Photosensitive member 14 | 2 | — | 1 | 4 | 7 | 15.9 |
| Photosensitive member 15 | 2 | — | 1 | 4 | 4 | 20 |
| Photosensitive member 16 | 2 | — | 1 | 4 | 8 | 10 |
| Photosensitive member 17 | 2 | — | 1 | 4 | 9 | 12 |
| Photosensitive member 18 | 2 | — | 1 | 4 | 10 | 13.6 |
| Photosensitive member 19 | 2 | — | 1 | 4 | 11 | 15.9 |
| Photosensitive member 20 | 2 | — | 1 | 4 | 12 | 20 |
| Photosensitive member 21 | 2 | — | 1 | 4 | 13 | 10 |
| Photosensitive member 22 | 2 | — | 1 | 4 | 14 | 13.6 |
| Photosensitive member 23 | 2 | — | 1 | 4 | 15 | 20 |
| Photosensitive member 24 | 2 | — | 1 | 2 | 2 | 20 |
| Comparative photosensitive member 1 | 2 | — | 1 | 4 | 16 | 9 |
| Comparative photosensitive member 2 | 2 | — | 1 | 4 | 17 | 21 |
| Comparative photosensitive member 3 | 2 | — | 1 | 4 | 18 | 9 |

Mounting onto Image Forming Apparatus

Examples 1 to 33 and Comparative Examples 1 to 5

Mounting onto an electrophotographic apparatus was performed in each of the combinations shown in Table 4.

Specifically, a reconstructed machine of a laser beam printer, (product name: MS812, manufactured by Lexmark) was used as the electrophotographic apparatus. The electrophotographic apparatus used for evaluation was reconstructed so as to be capable of adjusting and measuring an image exposure amount, the amount of a current flowing from a charging roller to the support of the electrophotographic photosensitive member (hereinafter sometimes referred to as total current), and a voltage applied to the charging roller.

<Black Spot Evaluation Method>

The occurrence of a black spot was evaluated under the following conditions using the electrophotographic apparatus mounted with any one of Examples 1 to 33 and Comparative Examples 1 to 5.

The electrophotographic apparatus mounted with the electrophotographic photosensitive member and the toner was left to stand under an environment having a temperature of 32° C. and a relative humidity 80% for 24 hours or more.

Under an environment having a temperature of 15° C. and a relative humidity of 10%, image output of a test chart having a print percentage of 1% was continuously performed on 100,000 sheets of A4-size plain paper. The image output of the test chart was performed by repeating continuous output on 5 sheets and a pause in output of 10 seconds.

After the 100,000-sheet endurance, the worst reflection density value F1 of the white background portion of the image and the average reflection density value F0 of the plain paper before image formation were measured, and a value obtained from F1-F0 was assigned to one of the black spot ranks A to M. A reflection densitometer (REFLECTOMETER MODEL TC-6DS, manufactured by Tokyo Denshoku Co., Ltd.) was used for the density measurement. A lower numerical value indicates a higher suppressive effect on the occurrence of a black spot. In this evaluation, Ranks A to K of the evaluation criteria were defined as preferred levels, and Rank L and Rank M were defined as unacceptable levels. The results are shown in Table 4.

Rank A: The F1-F0 value was less than 0.7.
Rank B: The F1-F0 value was 0.7 or more and less than 1.0.
Rank C: The F1-F0 value was 1.0 or more and less than 1.3.
Rank D: The F1-F0 value was 1.3 or more and less than 1.5.
Rank E: The F1-F0 value was 1.5 or more and less than 1.7.
Rank F: The F1-F0 value was 1.7 or more and less than 2.0.
Rank G: The F1-F0 value was 2.0 or more and less than 2.3.
Rank H: The F1-F0 value was 2.3 or more and less than 2.5.
Rank I: The F1-F0 value was 2.5 or more and less than 2.7.
Rank J: The F1-F0 value was 2.7 or more and less than 3.0.
Rank K: The F1-F0 value was 3.0 or more and less than 3.3.
Rank L: The F1-F0 value was 3.3 or more and less than 3.5.
Rank M: The F1-F0 value was 3.5 or more

TABLE 4

| | Photosensitive member | Toner | Black spot level |
|---|---|---|---|
| Example 1 | Photosensitive member 1 | Toner 1 | K |
| Example 2 | Photosensitive member 2 | Toner 2 | H |

TABLE 4-continued

| | Photosensitive member | Toner | Black spot level |
|---|---|---|---|
| Example 3 | Photosensitive member 3 | Toner 1 | K |
| Example 4 | Photosensitive member 4 | Toner 2 | H |
| Example 5 | Photosensitive member 5 | Toner 3 | J |
| Example 6 | Photosensitive member 6 | Toner 4 | G |
| Example 7 | Photosensitive member 7 | Toner 3 | J |
| Example 8 | Photosensitive member 8 | Toner 4 | G |
| Example 9 | Photosensitive member 9 | Toner 3 | I |
| Example 10 | Photosensitive member 10 | Toner 4 | G |
| Example 11 | Photosensitive member 11 | Toner 5 | B |
| Example 12 | Photosensitive member 12 | Toner 5 | C |
| Example 13 | Photosensitive member 13 | Toner 5 | C |
| Example 14 | Photosensitive member 14 | Toner 5 | C |
| Example 15 | Photosensitive member 15 | Toner 5 | E |
| Example 16 | Photosensitive member 11 | Toner 6 | B |
| Example 17 | Photosensitive member 12 | Toner 6 | B |
| Example 18 | Photosensitive member 13 | Toner 6 | B |
| Example 19 | Photosensitive member 14 | Toner 6 | B |
| Example 20 | Photosensitive member 15 | Toner 6 | E |
| Example 21 | Photosensitive member 16 | Toner 7 | D |
| Example 22 | Photosensitive member 17 | Toner 7 | D |
| Example 23 | Photosensitive member 18 | Toner 7 | D |
| Example 24 | Photosensitive member 19 | Toner 7 | D |
| Example 25 | Photosensitive member 20 | Toner 7 | F |
| Example 26 | Photosensitive member 21 | Toner 8 | C |
| Example 27 | Photosensitive member 22 | Toner 8 | C |
| Example 28 | Photosensitive member 23 | Toner 8 | F |
| Example 29 | Photosensitive member 12 | Toner 9 | A |
| Example 30 | Photosensitive member 13 | Toner 9 | A |
| Example 31 | Photosensitive member 12 | Toner 10 | B |
| Example 32 | Photosensitive member 13 | Toner 10 | B |
| Example 33 | Photosensitive member 24 | Toner 2 | G |
| Comparative Example 1 | Comparative photosensitive member 1 | Toner 5 | M |
| Comparative Example 2 | Comparative photosensitive member 2 | Toner 5 | M |
| Comparative Example 3 | Comparative photosensitive member 3 | Toner 5 | M |
| Comparative Example 4 | Photosensitive member 11 | Comparative Toner 1 | M |
| Comparative Example 5 | Photosensitive member 11 | Comparative Toner 2 | M |

A comparison of the results of Example 4 and Example 33 found that the arrangement of the oxide film on the outer surface of the support achieves a charge injection-suppressing effect that is comparative to or higher than that achieved by the arrangement of the undercoat layer on the support.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-049031, filed Mar. 15, 2019, which is hereby incorporated by reference herein in its entirety.

What is claimed is:

1. An electrophotographic image forming apparatus comprising:

an electrophotographic photosensitive member;

a charging device configured to charge the electrophotographic photosensitive member;

an exposing device configured to expose the electrophotographic photosensitive member to form an electrostatic latent image;

a developing device configured to develop the electrostatic latent image with a toner to form a toner image;

a transfer device configured to transfer the toner image from the electrophotographic photosensitive member onto a transfer material; and a cleaning device configured to remove the toner remaining on the electrophotographic photosensitive member with a cleaning blade after the toner image is transferred from the electrophotographic photosensitive member by the transfer device, wherein the developing device contains the toner, the toner contains toner particles each containing at least a resin, and an external additive, the toner has a volume-average particle diameter of 7 μm or more, the external additive contains a compound containing a titanium atom, a ratio B of a mass of the compound containing a titanium atom to a total mass of the toner is 0.6 mass % or more, the electrophotographic photosensitive member includes a support, a photosensitive layer, and a protective layer in the stated order, the protective layer contains a resin having a triarylamine structure and at least one structure selected from the group consisting of a structure represented by the general formula (1) and a structure represented by the general formula (2):

(1)

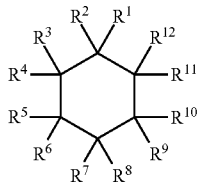

in the general formula (1), among $R^1$ to $R^{12}$, at least two of $R^1$, $R^5$, and $R^9$ each represent a structure represented by the general formula (3), and the others each represent a hydrogen atom or a methyl group;

(2)

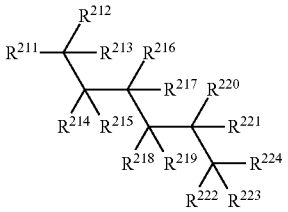

in the general formula (2), among $R^{211}$ to $R^{224}$, $R^{211}$ and $R^{224}$ each represent the structure represented by the general formula (3), and the others each represent a hydrogen atom or a methyl group:

(3)

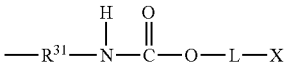

in the general formula (3), $R^{31}$ represents a single bond or a methylene group that may have a substituent, X represents a structure represented by the general formula (4), and L represents a group that links a non-carbonyl oxygen atom in the general formula (3) and a non-carbonyl oxygen atom in the general formula (4):

(4)

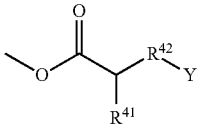

in the general formula (4), $R^{41}$ represents a hydrogen atom or a methyl group, $R^{42}$ represents a methylene group, and Y represents a bonding site with a polymer chain of the resin contained in the protective layer, and wherein a ratio A (mass %) of a total content of a structure represented by the general formula (1') and a structure represented by the general formula (2') in the protective layer to a total mass of the protective layer, which is determined by a pyrolysis-gas chromatography-mass spectrometric analysis of the protective layer, is 10 mass % or more and 20 mass % or less:

(1')

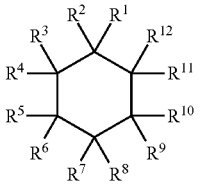

in the general formula (1'), among $R^{1}$ to $R^{12}$, at least two of $R^{1}$, $R^{5}$, and $R^{9}$ each represent a structure represented by the general formula (3'), and the others each represent a hydrogen atom or a methyl group;

(2')

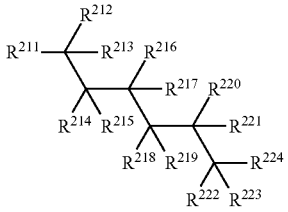

in the general formula (2'), among $R^{211}$ to $R^{224}$, $R^{211}$ and $R^{224}$ each represent the structure represented by the general formula (3'), and the others each represent a hydrogen atom or a methyl group:

$$—R^{31}—N=C=O \quad (3')$$

in the general formula (3'), $R^{31}$ represents a single bond or a methylene group that may have a substituent.

2. The electrophotographic apparatus according to claim 1, wherein the toner has a volume-average particle diameter of 7 μm or more and 11 μm or less.

3. The electrophotographic apparatus according to claim 1, wherein the external additive is strontium titanate.

4. The electrophotographic apparatus according to claim 1, wherein the resin contained in each of the toner particles is a crystalline polyester resin.

5. The electrophotographic apparatus according to claim 1, wherein a relationship of the ratio A and the ratio B (B/A) is 0.06 or more and 0.12 or less.

6. The electrophotographic apparatus according to claim 1, wherein the ratio A is 10 mass % or more and 16 mass % or less.

7. The electrophotographic apparatus according to claim 1, wherein the ratio B is 0.6 mass % or more and 1.0 mass % or less.

8. The electrophotographic apparatus according to claim 1, wherein L in the general formula (3) is at least one selected from the group consisting of a methylene group ($—CH_2—$), a group represented by the general formula (L1), and a group represented by the general formula (L2):

(L1)

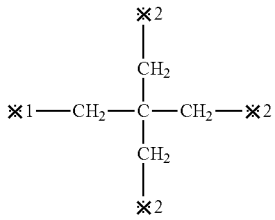

(L2)

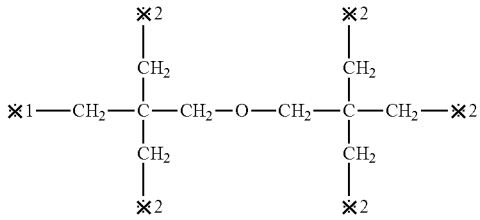

in the general formula (L1) and the general formula (L2), *1 represents a bonding site with the non-carbonyl oxygen atom in the general formula (3), and *2 represents a bonding site with the non-carbonyl oxygen atom in the general formula (4).

9. The electrophotographic apparatus according to claim 1, wherein the protective layer is a cured product of a coat of a coating liquid for a protective layer containing a first monomer and a second monomer, the first monomer is a monomer having, in a molecule thereof, at least one of the structure represented by the general formula (1) or the structure represented by the general formula (2), and two or more polymerizable functional groups, the second monomer is a monomer having, in a molecule thereof, the triarylamine structure and two or more polymerizable functional groups, and the polymerizable functional groups are each at least one of an acryloyloxy group or a methacryloyloxy group.

10. The electrophotographic apparatus according to claim 9, wherein the first monomer is at least one selected from the group consisting of compounds having structures represented by structural formulae (L-1) to (L-7).

(L-1)

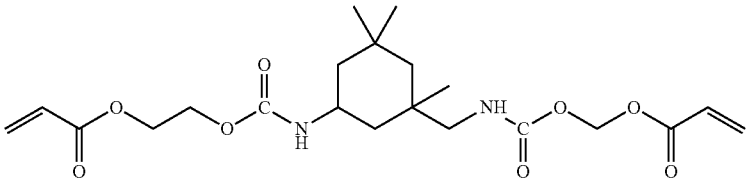

(L-2)

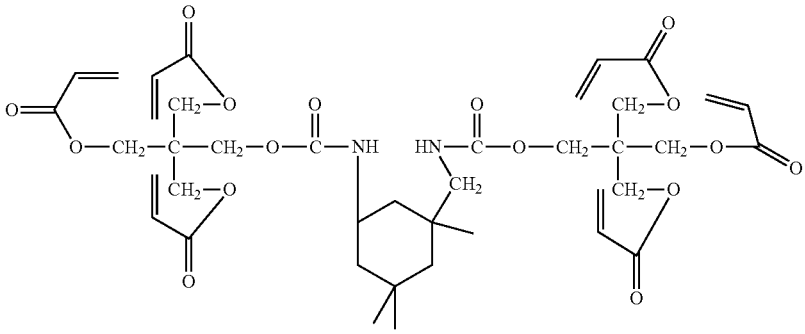

(L-3)

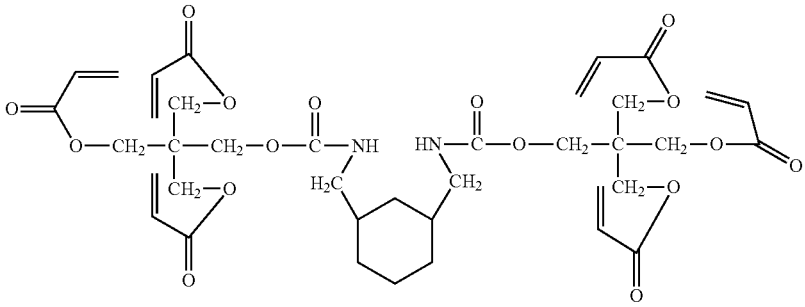

(L-4)

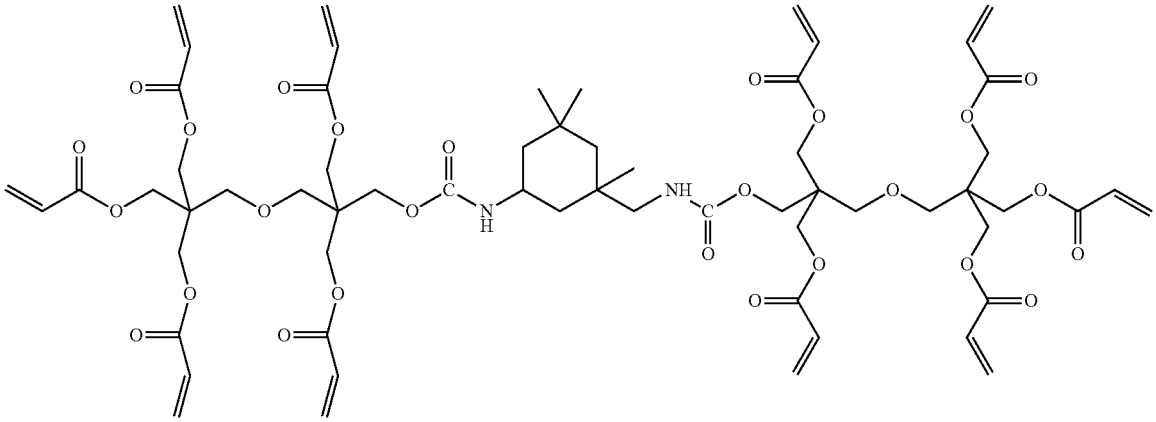

-continued
(L-5)
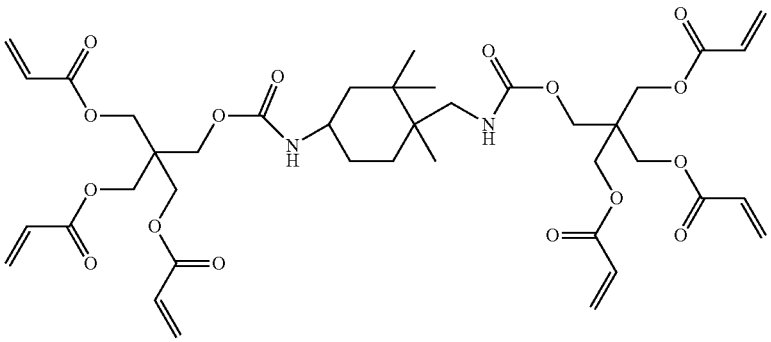
(L-6)
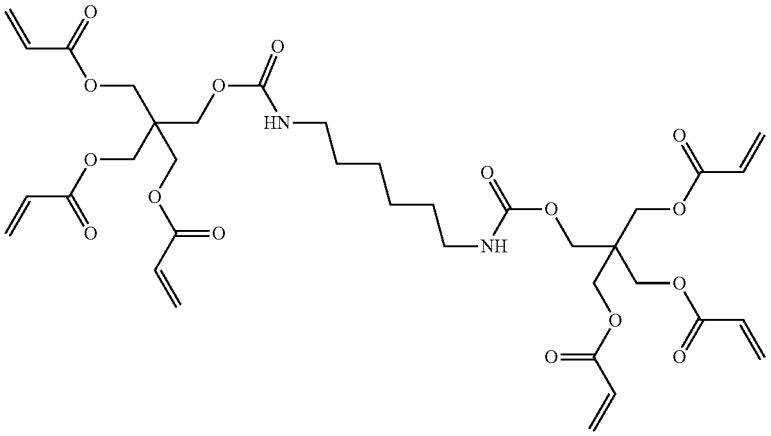
(L-7)
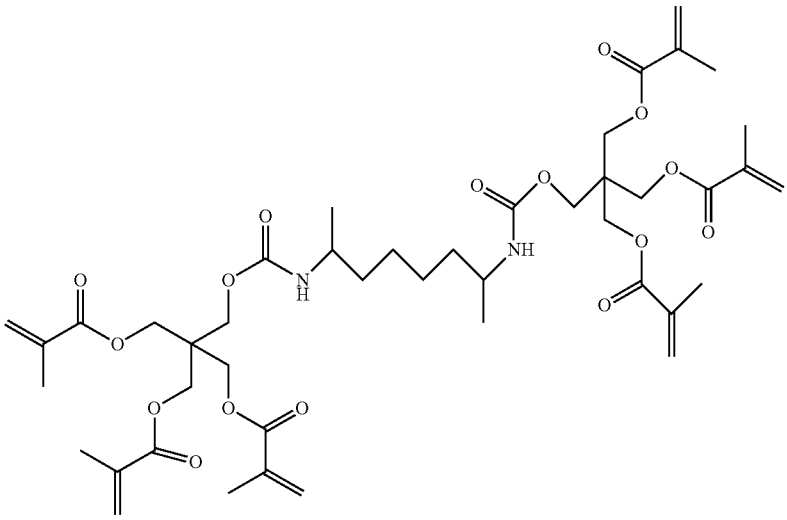
11. The electrophotographic apparatus according to claim 9, wherein the second monomer is at least one selected from the group consisting of compounds having structures represented by structural formulae (OCL-1) to (OCL-4).

(OCL-1)

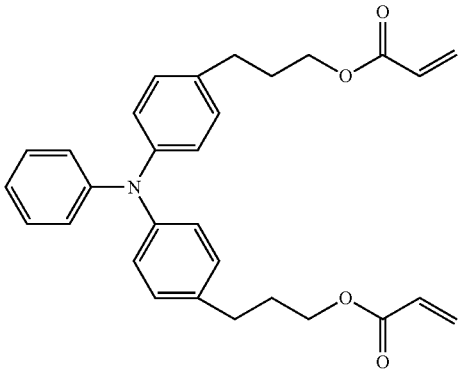

(OCL-2)

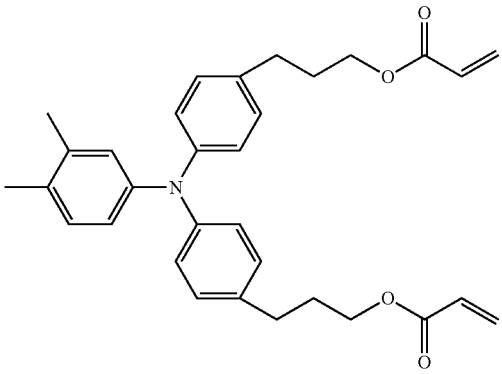

(OCL-3)

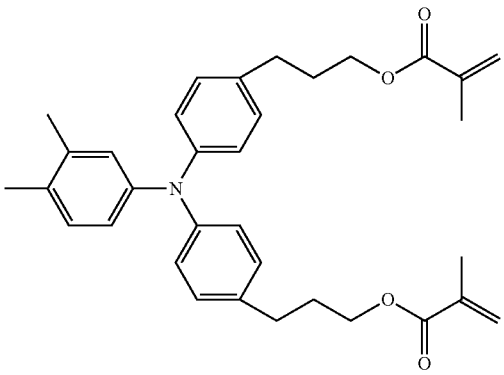

(OCL-4)

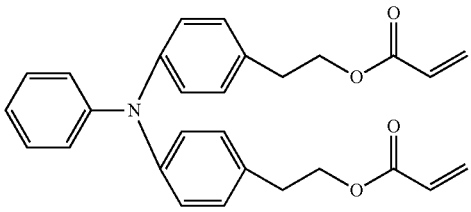

12. The electrophotographic apparatus according to claim 1, wherein the protective layer has a thickness of 0.5 μm or more and 10 μm or less.

13. The electrophotographic apparatus according to claim 1, wherein the support is an aluminum alloy having an oxide film on an outer surface thereof.

14. A process cartridge, which is removably mounted onto a main body of an electrophotographic apparatus, the process cartridge comprising:

an electrophotographic photosensitive member;

a charging device configured to charge the electrophotographic photosensitive member; and a developing device configured to supply a toner to the electrophotographic photosensitive member having an electrostatic latent image formed thereon to form a toner image on a surface of the electrophotographic photosensitive member, wherein the developing device contains the toner, the toner contains toner particles each containing at least a resin, and an external additive, the toner has a volume-average particle diameter of 7 μm or more, the external additive contains a compound containing a titanium atom, a ratio B of a mass of the compound containing a titanium atom to a total mass of the toner is 0.6 mass % or more, the electrophotographic photosensitive member includes a support, a photosensitive layer, and a protective layer in the stated order, the protective layer contains a resin having a triarylamine structure and at least one structure selected from the group consisting of a structure represented by the general formula (1) and a structure represented by the general formula (2):

(1)

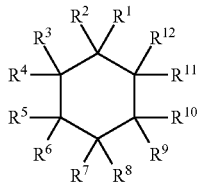

in the general formula (1), among $R^1$ to $R^{12}$, at least two of $R^1$, $R^5$, and $R^9$ each represent a structure represented by the general formula (3), and the others each represent a hydrogen atom or a methyl group;

(2)

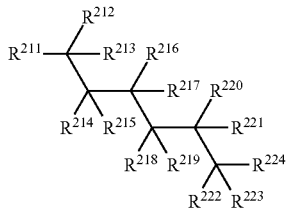

in the general formula (2), among $R^{211}$ to $R^{224}$, $R^{211}$ and $R^{224}$ each represent the structure represented by the general formula (3), and the others each represent a hydrogen atom or a methyl group:

(3)

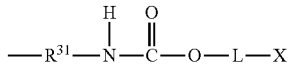

in the general formula (3), $R^{31}$ represents a single bond or a methylene group that may have a substituent, X represents a structure represented by the general formula (4), and L represents a group that links a non-carbonyl oxygen atom in the general formula (3) and a non-carbonyl oxygen atom in the general formula (4):

(4)

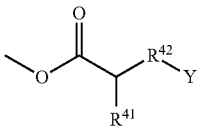

in the general formula (4), $R^{41}$ represents a hydrogen atom or a methyl group, $R^{42}$ represents a methylene group, and Y represents a bonding site with a polymer chain of the resin contained in the protective layer, and wherein a ratio A (mass %) of a total content of a structure represented by the general formula (1') and a structure represented by the general formula (2') in the protective layer to a total mass of the protective layer, which is determined by a pyrolysis-gas chromatography-mass spectrometric analysis of the protective layer, is 10 mass % or more and 20 mass % or less:

(1')

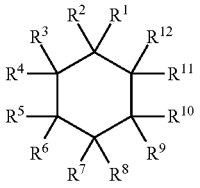

in the general formula (1'), among $R^1$ to $R^{12}$, at least two of $R^1$, $R^5$, and $R^9$ each represent a structure represented by the general formula (3'), and the others each represent a hydrogen atom or a methyl group;

(2')

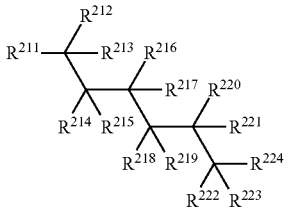

in the general formula (2'), among $R^{211}$ to $R^{224}$, $R^{211}$ and $R^{224}$ each represent the structure represented by the general formula (3'), and the others each represent a hydrogen atom or a methyl group:

$$—R^{31}—N=C=O \quad (3')$$

in the general formula (3'), $R^{31}$ represents a single bond or a methylene group that may have a substituent.

* * * * *